US010831120B2

(12) United States Patent
Tanaka et al.

(10) Patent No.: US 10,831,120 B2
(45) Date of Patent: Nov. 10, 2020

(54) IMAGE FORMING APPARATUS

(71) Applicant: CANON KABUSHIKI KAISHA, Tokyo (JP)

(72) Inventors: Takayuki Tanaka, Tokyo (JP); Shinji Katagiri, Yokohama (JP); Eiji Akasaka, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/135,410

(22) Filed: Sep. 19, 2018

(65) Prior Publication Data

US 2019/0094740 A1 Mar. 28, 2019

(30) Foreign Application Priority Data

Sep. 26, 2017 (JP) ..... 2017-185300

(51) Int. Cl.
*G03G 15/16* (2006.01)
*G03G 15/02* (2006.01)
*G03G 15/01* (2006.01)

(52) U.S. Cl.
CPC ..... *G03G 15/0225* (2013.01); *G03G 15/0189* (2013.01); *G03G 15/0258* (2013.01); *G03G 2221/0005* (2013.01)

(58) Field of Classification Search
USPC ..... 399/34
See application file for complete search history.

(56) References Cited

U.S. PATENT DOCUMENTS 5,676,363 A * 10/1997 Kishida ..... B65H 7/02 271/10.01
6,215,967 B1 4/2001 Takeda et al.
6,987,939 B2 1/2006 Ishiyama et al.
7,239,827 B2 7/2007 Furukawa
7,738,815 B2 6/2010 Hirota
7,941,075 B2 * 5/2011 Shiraishi ..... G03G 21/0064 399/129
2005/0220489 A1 10/2005 Furukawa
(Continued)

FOREIGN PATENT DOCUMENTS

JP 11-184218 A 7/1999
JP 2000-314993 A 11/2000
(Continued)

OTHER PUBLICATIONS

Computer translation of cited reference JP11-184218 to Takeda et al., published Jul. 9, 1999 (Year: 1999).*
(Continued)

*Primary Examiner* — Quana Grainger
(74) *Attorney, Agent, or Firm* — Venable LLP

(57) ABSTRACT

An image forming apparatus includes first and second image bearing members; first and second charging members; first and second developing members; a transfer member configured to sequentially transfer toner images from the first and second image bearing members to a transfer-receiving member; and a control portion configured to, at a timing determined based on information relating to the toner image formed on the first image bearing member, perform a cleaning operation of decreasing toner that adheres to the second charging member at a time of non-image formation.

14 Claims, 10 Drawing Sheets

(56) References Cited

U.S. PATENT DOCUMENTS

| | | | | |
|---|---|---|---|---|
| 2007/0286643 | A1* | 12/2007 | Kinokuni | G03G 21/0064 399/128 |
| 2008/0212988 | A1 | 9/2008 | Hirota | |
| 2009/0129795 | A1 | 5/2009 | Shimmura | |
| 2014/0340457 | A1* | 11/2014 | Hashimoto | G03G 21/0011 347/118 |

FOREIGN PATENT DOCUMENTS

| | | | |
|---|---|---|---|
| JP | 2004-021178 | A | 1/2004 |
| JP | 2004-126202 | A | 4/2004 |
| JP | 2005-316371 | A | 11/2005 |
| JP | 2008-203519 | A | 9/2008 |
| JP | 2011-017817 | A | 1/2011 |
| JP | 2015-011159 | A | 1/2015 |

OTHER PUBLICATIONS

Office Action dated Aug. 6, 2019, issued in Japanese Patent Application No. 2018-178121.
Office Action dated Nov. 12, 2019, in Japanese Patent Application No. 2018-178121.

* cited by examiner

IMAGE FORMING APPARATUS

BACKGROUND OF THE DISCLOSURE

Field of the Disclosure

The disclosure relates to an image forming apparatus such as a copier, a printer or a facsimile machine that uses an electrophotographic method or an electrostatic recording method or the like.

Description of the Related Art

Conventionally, as an image forming apparatus that uses an electrophotographic method or the like, an in-line type image forming apparatus is available in which a plurality of image forming portions each having an image bearing member such as a photosensitive drum are disposed side-by-side along a direction of movement of a transfer-receiving member. In an in-line type image forming apparatus, a full-color image or the like is formed by sequentially transferring toner images formed on the respective image bearing members of the image forming portions so that the toner images are superposed on, as a transfer-receiving member, an intermediate transfer member or a recording material that is borne on a recording material carrying member.

In such image forming apparatuses, a so-called "cleanerless configuration" is sometimes adopted in which a dedicated cleaning apparatus that recovers toner (un-transferred residual toner) that remained on the surface of the image bearing members after transfer of the toner images from the image bearing members to the transfer-receiving member is not provided. In a cleanerless configuration, the un-transferred residual toner is recovered by a developing member. The cleanerless configuration is advantageous for reducing the size and lowering the cost of an image forming apparatus.

In this connection, in an image forming apparatus that uses an electrophotographic method or the like, in some cases toner (hereinafter, also referred to as "reversely charged toner") charged with reverse polarity to the normal charge polarity that adhered to an image bearing member adheres to a charging member such as a charging roller that electrostatically charges the image bearing member. In an in-line type image forming apparatus, as reversely charged toner that adheres to a charging member, toner that caused a "retransfer" whereby toner that was transferred to a transfer-receiving member at an upstream image forming portion moves to an image bearing member at a transfer portion of a downstream image forming portion is conspicuous. In addition, in the aforementioned cleanerless configuration, the adherence of reversely charged toner to a charging member is conspicuous. Further, when toner adheres to a charging member, in some cases the capability of the charging member to charge the image bearing member changes, the latent image potential of a portion of the charging member corresponding to the position at which the toner is adhered changes, and the image density changes.

Japanese Patent Application Laid-Open No. 2004-126202 discloses a configuration in which, as a maintenance operation for suppressing such changes in image density, a cleaning operation is performed on a charging member. Specifically, first, by making the polarity of a voltage applied to a charging roller a reverse polarity to the polarity of a voltage applied at a time of image formation, toner adhering to the charging roller is expelled onto a photosensitive drum. Thereafter, the polarity of a voltage applied to a transfer member that is provided at a position facing the photosensitive drum across a belt is made a reverse polarity to the polarity at a time of image formation. By this means, the toner that was expelled onto the photosensitive drum is transferred onto the belt, and the toner is recovered by a cleaning member for the belt. In the configuration disclosed in Japanese Patent Application Laid-Open No. 2004-126202, the maintenance operation is performed in accordance with an integrated number of printed sheets, an integrated number of printed pixels or an integrated light exposure time period. In Japanese Patent Application Laid-Open No. 2011-17817, in relation to a maintenance operation for reducing an optical memory of a photosensitive drum, a configuration is disclosed in which a maintenance operation is performed according to a pixel number count value for each position in the axial direction of a photosensitive drum.

If the intervals at which a maintenance operation is performed are short, the throughput (number of images that can be output per unit time) of the image forming apparatus decreases. Conversely, if the intervals at which a maintenance operation is performed are long, a defective image occurs and the image quality decreases. Therefore, in order to compatibly achieve both a favorable throughput and favorable image quality, it is desirable to determine an appropriate timing at which to perform a maintenance operation.

In particular, in an in-line type image forming apparatus, reversely charged toner adhering to a charging member that is toner which is attributable to a retransfer is conspicuous. Therefore, even if the timing for performing a cleaning operation on a charging member as a maintenance operation is determined merely on the basis of image information regarding the number of printed sheets or output images, in some cases a maintenance operation cannot be performed at an appropriate timing, and it is difficult to compatibly achieve both a favorable throughput and favorable image quality as described above.

SUMMARY OF THE DISCLOSURE

Therefore, the disclosure is to provide an image forming apparatus that, by performing a maintenance operation at an appropriate timing, can suppress a decrease in image quality while suppressing a decrease in throughput.

In more detail, the disclosure is to provide an in-line type image forming apparatus that, by performing an operation that cleans a charging member at an appropriate timing, can suppress the occurrence of image density fluctuations while suppressing a decrease in throughput.

In further detail, the disclosure is to provide an image forming apparatus that, by performing a supply operation configured to supply toner to a cleaning portion of an intermediate transfer member at an appropriate timing, can suppress the occurrence of cleaning defects with respect to the intermediate transfer member while suppressing a decrease in throughput.

According to a first aspect of the disclosure, there is provided an image forming apparatus configured to form a toner image on a recording material, the image forming apparatus comprising:

a plurality of image forming portions which each have an image bearing member, a charging member configured to contact the image bearing member to charge a surface of the image bearing member, and a developing member configured to supply toner onto the image bearing member, and which each form a toner image on the image bearing member based on image data;

an intermediate transfer member onto which toner images formed on respective image bearing members of the plurality of the image forming portions are sequentially transferred at transfer nip portions and which rotates while bearing the toner images on a surface of the intermediate transfer member, the transfer nip portions being formed between the respective image bearing members of the plurality of the image forming portions and the intermediate transfer member contacting the respective image bearing members;

a transfer member configured to transfer the toner images, which are transferred onto the intermediate transfer member, onto the recording material;

an obtaining portion configured to obtain information relating to a print pixel area from the image data; and a control portion configured to perform a cleaning operation of cleaning the charging member at a time of non-image formation, wherein when, among the plurality of image forming portions, an image forming portion disposed at a nearest position to the transfer member on a downstream side of the transfer member in a rotational direction of the intermediate transfer member is taken as a first image forming portion, and an image forming portion disposed downstream of the first image forming portion in the rotational direction of the intermediate transfer member is taken as a second image forming portion, the control portion controls a timing of performing the cleaning operation with respect to the second image forming portion based on the information relating to the print pixel area of the toner image that is formed on the image bearing member of an image forming portion that is disposed upstream of the second image forming portion in the rotational direction of the intermediate transfer member.

Further features of the present disclosure will become apparent from the following description of exemplary embodiments with reference to the attached drawings.

DESCRIPTION OF THE EMBODIMENTS

Hereunder, an image forming apparatus according to the present disclosure will be described in further detail in accordance with the accompanying drawings.

[Embodiment 1]

1. Overall Configuration and Operations of Image Forming Apparatus

Figure 1:
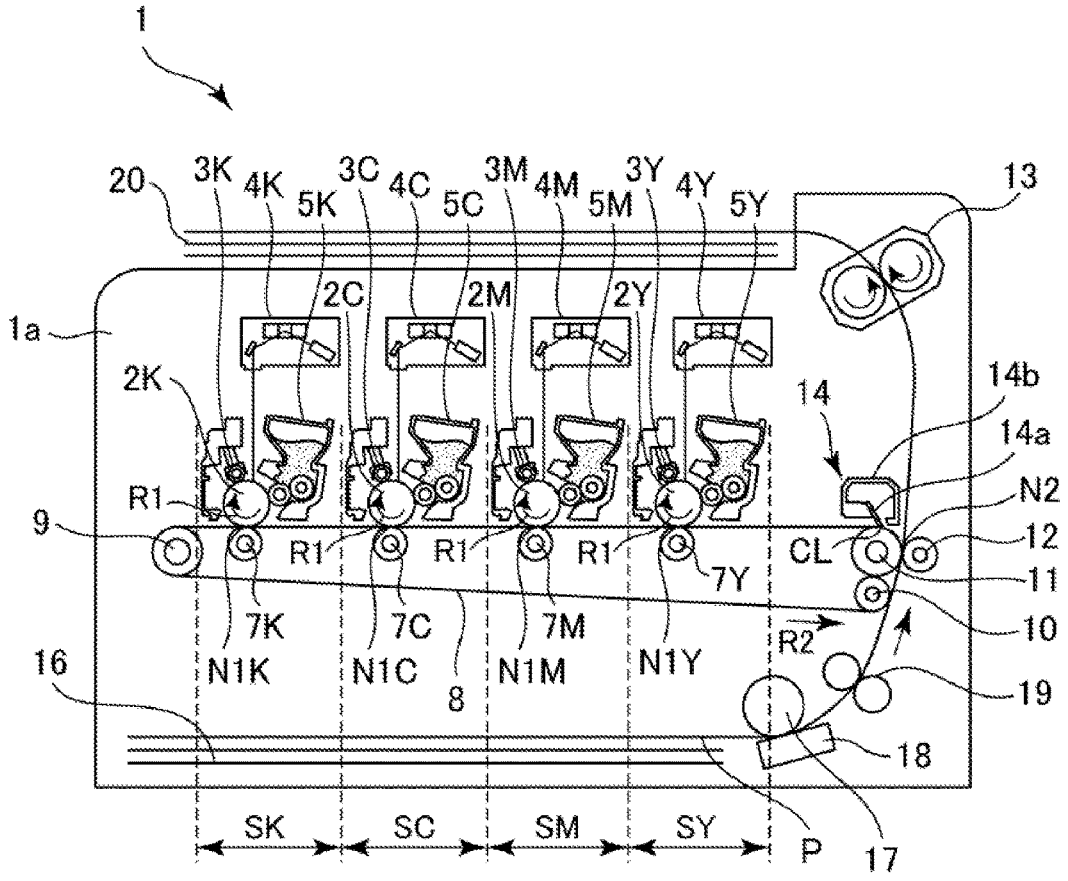
FIG. 1 is a schematic cross-sectional view of an image forming apparatus.
Figure 2:
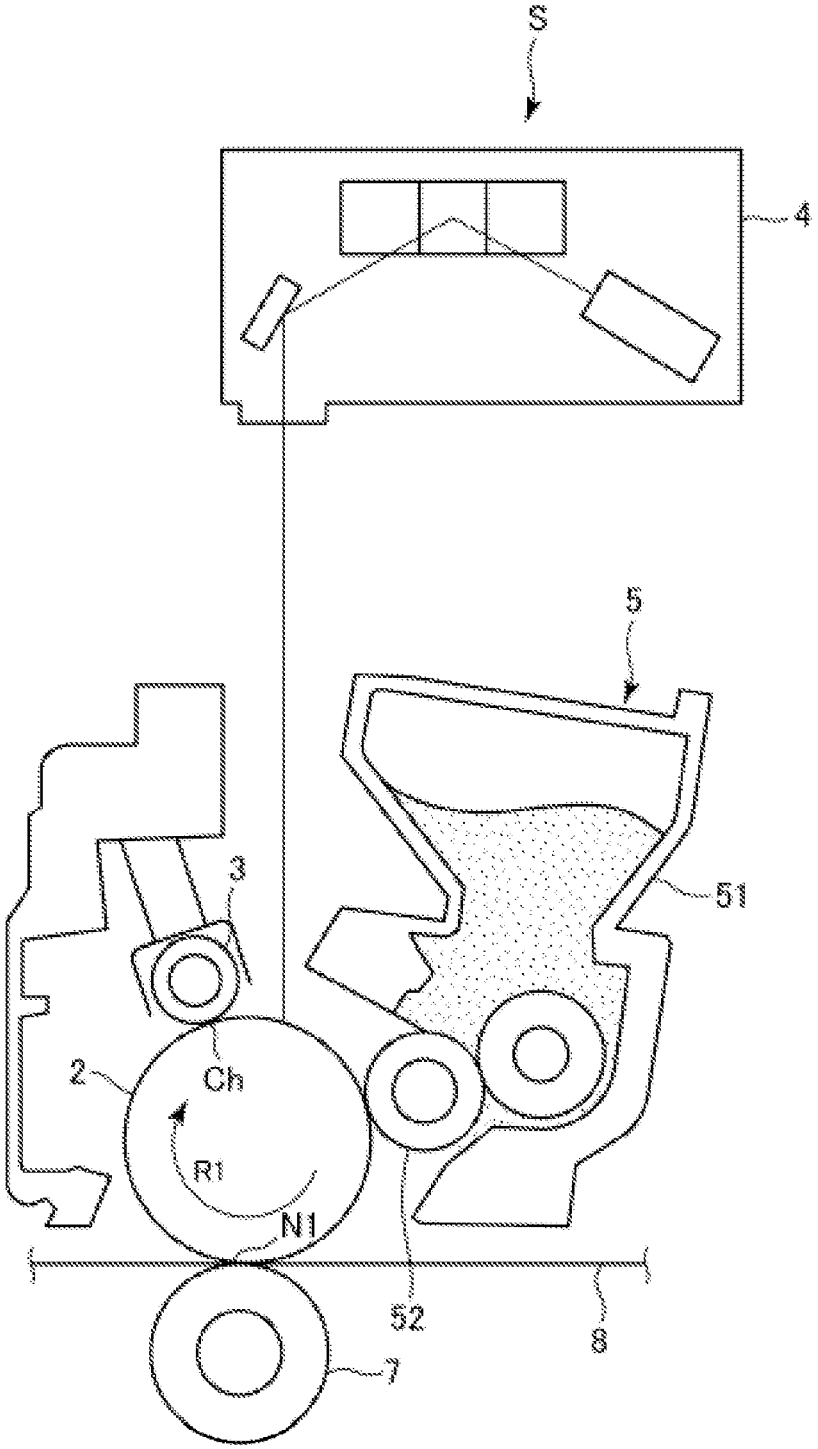
FIG. 2 is a schematic cross-sectional view of an image forming portion.

FIG. 1 is a schematic cross-sectional view of an image forming apparatus 1 according to the present embodiment. The image forming apparatus 1 of the present embodiment is an in-line type laser beam printer that can form a full-color image using an electrophotographic method. The image forming apparatus 1 has image forming portions SY, SM, SC and SK that form images of the colors yellow (Y), magenta (M), cyan (C) and black (K), respectively. With respect to elements having the same or corresponding functions or configurations among the respective image forming portions SY, SM, SC and SK, in some cases the characters Y, M, C and K, which are added to the end of the reference characters and which indicate which color the relevant element is provided for use for, may be omitted, and the elements collectively described. FIG. 2 is a schematic cross-sectional view illustrating one image forming portion S as a representative example of the image forming portions SY, SM, SC and SK. In the present embodiment, the image forming portion S is configured to include a photosensitive drum 2, a charging roller 3, an exposure device 4, a developing device 5 and a primary transfer roller 7 that will be described later.

Figure 3:
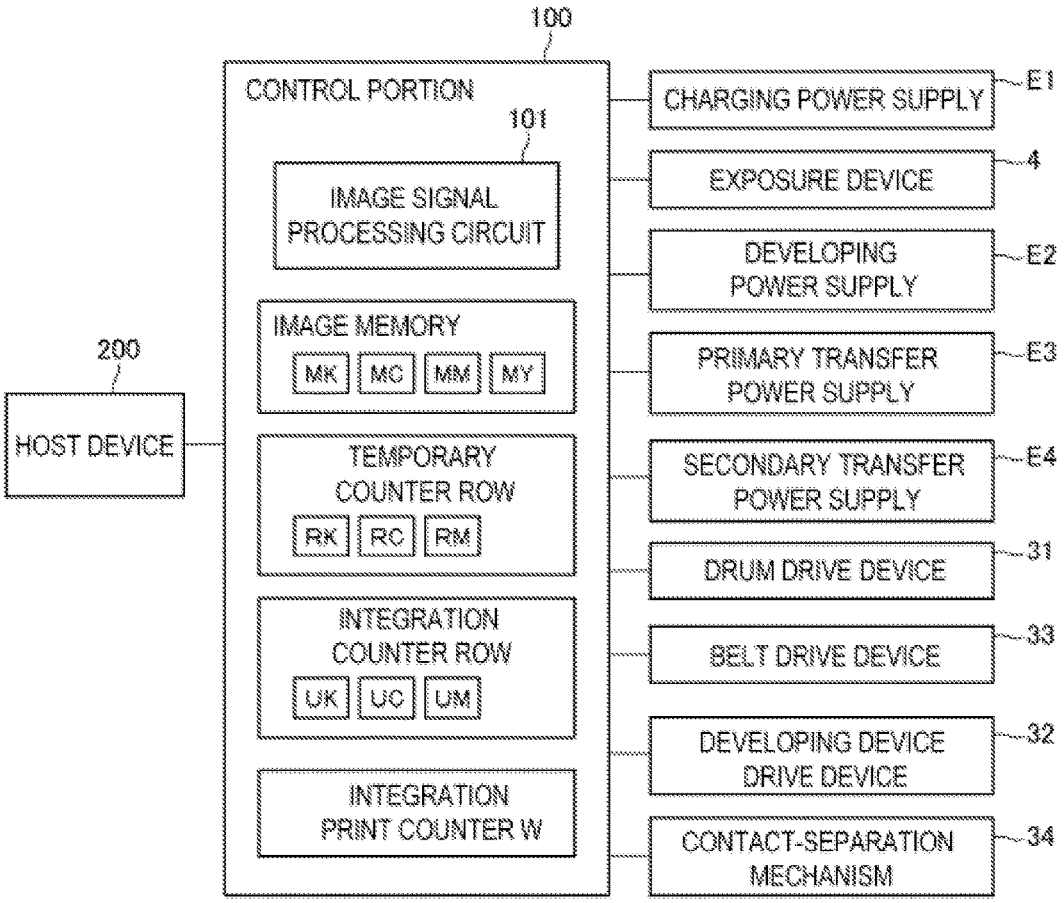
FIG. 3 is a schematic block diagram illustrating a control form of principal parts of an image forming apparatus of Embodiment 1.

The image forming apparatus 1 has the photosensitive drum 2 that is a rotatable drum-type electrophotographic photosensitive member as an image bearing member that bears toner images. Photosensitive drums 2Y, 2M, 2C and 2K for the respective colors are disposed at fixed intervals in contact with a face on the upward side in the vertical direction of an intermediate transfer belt 8 that will be described later. In the present embodiment, the photosensitive drum 2 is an organic photosensitive drum having a photoconductive layer on a conductive support body. The photosensitive drum 2 is driven by a motor (not shown) of a drum drive device 31 as a drive unit that is illustrated in FIG. 3 and rotates in the direction of an arrow R1 in FIG. 1.

The surface of the rotating photosensitive drum 2 is charged to a predetermined potential of a predetermined polarity (a negative polarity in the present embodiment) by contacting the charging roller 3 that is a roller-type charging member as a charging unit. At a time of a charging process, a charging voltage that is a direct current voltage of negative polarity is applied to the charging roller 3 from a charging power supply (high-voltage power supply circuit) El illustrated in FIG. 3. In the present embodiment, at the time of the charging process, a direct current voltage of −1100 V is applied to the charging roller 3. By this means, the surface of the photosensitive drum 2 is charged, and a uniform charging potential of −500 V is formed. In the present embodiment, the charging roller 3 is an elastic roller having a conductive elastic body layer on a metal core. The charging roller 3 is caused to contact the surface of the photosensitive drum 2 with a predetermined pressing force, and to rotate to follow the rotation of the photosensitive drum 2 when the photosensitive drum 2 rotates. The charging roller 3 charges the surface of the photosensitive drum 2 by an electric discharge that arises at gaps between the photosensitive drum 2 and the charging roller 3 formed on an upstream side and a downstream side of a contact portion (hereinafter, also referred to as "charging nip") between the photosensitive drum 2 and the charging roller 3 in the direction of movement of the surface of the photosensitive drum 2.

The charged surface of the photosensitive drum 2 is subjected to scanning exposure in accordance with image data by the exposure device 4 as an exposure unit, to thereby form an electrostatic latent image on the photosensitive drum 2. In the present embodiment, the exposure device 4 is a laser scanner apparatus that irradiates the surface of the photosensitive drum 2 with a laser beam modulated in accordance with a laser drive signal. The exposure device 4 scans the laser beam approximately parallel to the rotation axis direction of the photosensitive drum 2. Further, accompanying rotation of the photosensitive drum 2, the exposure device 4 scans the laser beam approximately parallel to movement direction of the surface of the photosensitive drum 2. Hereunder, the direction of the rotation axis of the photosensitive drum 2 (direction approximately orthogonal to the movement direction of the surface) is referred to as "main scanning direction". Further, the direction that is approximately orthogonal to the "main scanning direction" is referred to as "sub-scanning direction". In the present embodiment, the surface potential of the photosensitive drum 2 at a portion subjected to exposure with the maximum light amount by the exposure device 4 becomes approximately −100 V. That is, when the surface of the photosensitive drum 2 that was uniformly charged is exposed, the absolute value of the surface potential decreases and a latent image potential (exposed portion potential) is formed.

The electrostatic latent image formed on the photosensitive drum 2 is visualized by development using a toner as a developer by the developing device 5 as a developing member, and a toner image is thereby formed on the photosensitive drum 2. The developing device 5 includes a developer container 51 that stores toner, and a developing roller 52 as a developer carrying member. The developing roller 52 rotates upon being subjected to driving by a motor (not shown) of a developing device drive device 32 as a drive unit that is illustrated in FIG. 3. The developing device 5 transports toner that was charged to a negative polarity that is the normal charge polarity which was coated on the developing roller 52 to a developing portion that is a contact portion with the photosensitive drum 2 by rotation of the developing roller 52. Further, the developing roller 52 is configured to be able to contact against and separate from the photosensitive drum 2 by a contact-separation mechanism 34 as a contact-separation unit illustrated in FIG. 3. At the time of the development process, the developing roller 52 is caused to contact against the photosensitive drum 2. Further, at the time of the development process, a developing voltage that is a direct current voltage of negative polarity is applied to the developing roller 52 from a developing power supply (high-voltage power supply circuit) E2 illustrated in FIG. 3. In the present embodiment, at the time of the development process, a direct current voltage of −300 V is applied to the developing roller 52. When the electrostatic latent image formed on the photosensitive drum 2 contacts the developing roller 52, by an electric field between the electrostatic latent image of the photosensitive drum 2 and the developing roller 52, toner charged to a normal charge polarity adheres to the latent image potential portion on the photosensitive drum 2, and the electrostatic latent image on the photosensitive drum 2 is developed as a toner image. Because an electric field at a charging potential portion on the photosensitive drum 2 is opposite to the electric field at the latent image potential portion, the toner that was charged to the normal charge polarity does not adhere thereto.

The intermediate transfer belt 8 that is formed by an endless belt as a rotatable intermediate transfer member is disposed so as to face the respective photosensitive drums 2Y, 2M, 2C and 2K. The intermediate transfer belt 8 is suspended around a drive roller 9, a tension roller 10 and a secondary transfer inner roller 11 as a plurality of supporting rollers, and is supported with a predetermined tensile force. When the drive roller 9 rotates upon receiving a driving force from a motor (not shown) of a belt drive device 33 as a drive unit that is illustrated in FIG. 3, the intermediate transfer belt 8 rotates in the direction of an arrow R2 in FIG. 1. The respective primary transfer rollers 7 that are roller-type primary transfer members are disposed on the inner circumferential surface side of the intermediate transfer belt 8 in correspondence with the respective photosensitive drums 2. Each primary transfer roller 7 is pressed toward the corresponding photosensitive drum 2 with the intermediate transfer belt 8 interposed therebetween, to thereby form a primary transfer nip N1 that is a contact portion between the photosensitive drum 2 and the intermediate transfer belt 8. As described above, in the course of passing through the primary transfer nip N1, by an electric field between the photosensitive drum 2 and the primary transfer roller 7, the toner image formed on the photosensitive drum 2 is subjected to a primary transfer onto the intermediate transfer belt 8 which is nipped and conveyed between the photosensitive drum 2 and the primary transfer roller 7. At the time of the primary transfer process, a primary transfer voltage that is a direct current voltage of reverse polarity to the normal charge polarity of the toner is applied to the primary transfer roller 7 from a primary transfer power supply (high-voltage power supply circuit) E3 illustrated in FIG. 3. In the present embodiment, at the time of the primary transfer process, a direct current voltage of +600 V is applied to the primary transfer roller 7. For example, at a time of formation of a full-color image, in the course of the intermediate transfer belt 8 sequentially passing through the primary transfer nips N1Y, N1M, N1C and N1K, toner images formed on the respective photosensitive drums 2Y, 2M, 2C and 2K sequentially undergo primary transfer onto the intermediate transfer belt 8. Thus, a multilayered toner image in which toners of a plurality of colors are superposed is formed on the intermediate transfer belt 8.

On the outer circumferential surface side of the intermediate transfer belt 8, a secondary transfer outer roller 12 that is a roller-type secondary transfer member is disposed at a position facing the secondary transfer inner roller 11. The secondary transfer outer roller 12 is pressed toward the secondary transfer inner roller 11 with the intermediate transfer belt 8 interposed therebetween, to thereby form a secondary transfer nip N2 that is a contact portion between the intermediate transfer belt 8 and the secondary transfer outer roller 12. As described above, by an electric field between the intermediate transfer belt 8 and the secondary transfer outer roller 12, the toner image formed on the intermediate transfer belt 8 is subjected to secondary transfer onto a recording material P which is nipped and conveyed between the intermediate transfer belt 8 and the secondary transfer outer roller 12. At the time of the secondary transfer process, a secondary transfer voltage that is a direct current voltage of reverse polarity to the normal charge polarity of the toner is applied to the secondary transfer outer roller 12 from a secondary transfer power supply (high-voltage power supply circuit) E4 illustrated in FIG. 3. In the present embodiment, at the time of the secondary transfer process, a direct current voltage of +1500 V is applied to the secondary transfer outer roller 12.

A recording material (transfer material, recording medium, sheet) P such as a recording paper is stored in a feeding tray 16. In the present embodiment, a letter-size sheet of plain paper having a length of 279.4 mm in the conveying direction is used as the recording material P. The sheets of recording material P in the feeding tray 16 are picked up one sheet at a time by rotation of a feed roller 17. The sheets of recording material P are separated into single sheets by friction with a separation pad 18, and each separated sheet of the recording material P is conveyed toward a pair of registration rollers 19. The recording material P is then caused to stop while a skew of the recording material P is corrected by the pair of registration rollers 19. Thereafter, by the pair of registration rollers 19 being rotated at a timing at which the leading edge of the toner image formed on the intermediate transfer belt 8 and the leading edge of the recording material P arrive approximately simultaneously at the secondary transfer nip N2, the recording material P is caused to enter the secondary transfer nip N2. The recording material P onto which the toner image has been transferred is then conveyed to a fixing device 13 as a fixing unit. The recording material P is heated while being pressed by a pair of fixing rollers that the fixing device 13 is equipped with, to thereby fix the toner image on the recording material P. The recording material P on which the toner image was fixed is then discharged onto a discharge tray 20 provided on the outside of a main body la of the image forming apparatus 1.

On the outer circumferential surface side of the intermediate transfer belt 8, a belt cleaning apparatus 14 as an intermediate transfer member cleaning member is arranged at a position that is downstream of the secondary transfer nip N2 and upstream of the most upstream primary transfer nip N1Y in the direction of movement of the surface of the intermediate transfer belt 8. Toner that remained on the intermediate transfer belt 8 after the secondary transfer is removed from the intermediate transfer belt 8 and recovered by the belt cleaning apparatus 14. The belt cleaning apparatus 14 has a cleaning member 14*a* and a recovery container 14*b*. In the present embodiment, the cleaning member 14*a* is a cleaning blade made of rubber that is supported by a metal plate. The cleaning member 14*a* is disposed so that the longitudinal direction thereof is along a direction (main scanning direction) that is approximately orthogonal to the direction of movement of the surface of the intermediate transfer belt 8, and an edge of a free end in the short-side direction thereof is caused to contact against the surface of the intermediate transfer belt 8. Secondary un-transferred residual toner on the intermediate transfer belt 8 is scraped off by the cleaning member 14*a*, and recovered in the recovery container 14*b*.

2. Control Form

FIG. 3 is a schematic block diagram illustrating a control form of principal parts of the image forming apparatus 1 of the present embodiment. A control portion 100 as a control unit is provided in the main body 1*a* of the image forming apparatus 1. The control portion 100 includes a CPU as an arithmetic and control unit, and a ROM or RAM as a storage unit and the like. The CPU performs overall control of the operations of each portion of the image forming apparatus 1 while using the RAM as a working space, in accordance with a program stored in the ROM. For example, the drum drive device 31, the developing device drive device 32, the belt drive device 33, the contact-separation mechanism 34, the various power supplies E1, E2, E3 and E4, and the exposure device 4 are connected to the control portion 100. Further, an image signal processing circuit 101, image memories MY, MM, MC and MK, temporary counter rows RM, RC and RK, integration counter rows UM, UC and UK, and an integration print counter W which will be described in detail later are provided in the control portion 100. Note that, although not illustrated in FIG. 3, in the present embodiment the charging power supply E1, the developing power supply E2, and the primary transfer power supply E3 are independently provided for each of the image forming portions SY, SM, SC and SK.

A host device 200 such as a personal computer is connected through an interface to the control portion 100. The control portion 100 performs control of an image forming operation so as to form an image that corresponds to image data which is electrical image information that is input from the host device 200 on the recording material P, and output the recording material P having the image thereon. Further, the control portion 100 performs control of a cleaning operation on the charging roller 3, and control for a determination on performing a cleaning operation on the charging roller 3 which will be described in detail later.

In this case, the image forming apparatus 1 performs a print job which is a series of operations started by a single start instruction and which form an image on one or a plurality of the recording materials P and output the resulting recording material(s) P having the image thereon. The print job generally includes an image forming process, a pre-rotation process, a sheet-to-sheet interval process in a case where an image is to be formed on a plurality of the recording materials P, and a post-rotation process. The image forming process is a time period for performing formation of an electrostatic latent image of the image to be actually formed and output on the recording material P, formation of a toner image, and primary transfer and secondary transfer of the toner image, and the term "at a time of image formation" refers to this period. More specifically, the timing of the aforementioned "time of image formation" differs depending on the positions at which the respective processes of the formation of the electrostatic latent image, the formation of the toner image, and the primary transfer and secondary transfer of the toner image are performed. The pre-rotation process is a time period for performing a preparation operation prior to the image forming process, and is a period of time from when a start instruction is input until formation of the image actually starts. The sheet interval process is a time period corresponding to an interval between one recording material P and a next recording material P when image forming is consecutively performed with respect to a plurality of the recording materials P. The post-rotation process is a time period for performing preparation operations after the image forming process. The term "at a time of non-image formation" refers to a period other than a period at a time of image formation, and includes the aforementioned pre-rotation process, sheet interval process, post-rotation process and, furthermore, a pre-multi-rotation process which is a preparation operation when the power of the image forming apparatus 1 is turned on or when reverting from a sleep state and the like. In the present embodiment, a cleaning operation on the charging roller 3 which will be described in detail later is performed at a time of non-image formation.

3. Operational Sequence of Print Job

Figure 4:
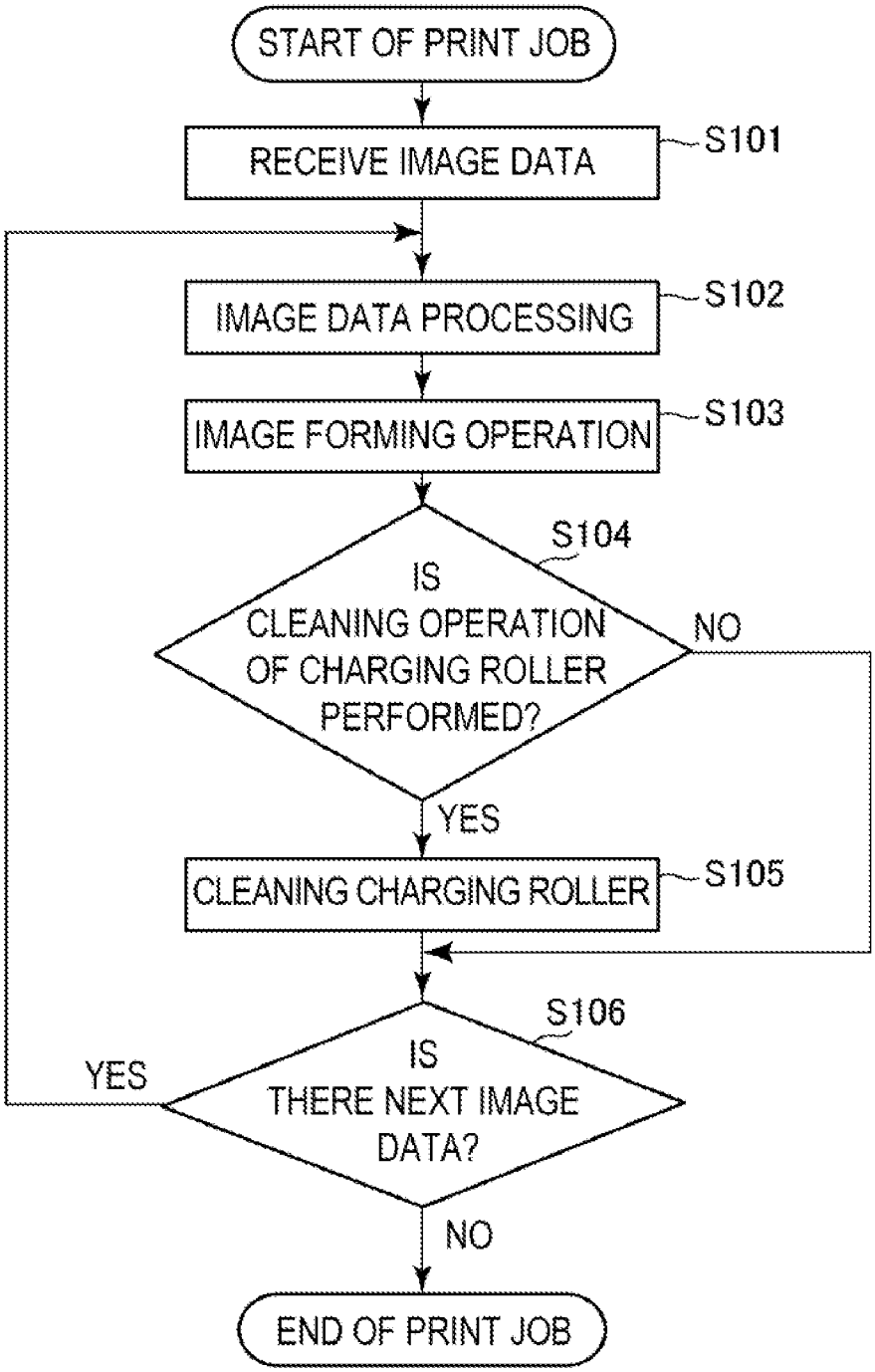
FIG. 4 is a flowchart illustrating an operational sequence of the image forming apparatus of Embodiment 1.

FIG. 4 is a flowchart illustrating an outline of the operational sequence of a print job in the present embodiment.

When a print job start signal is sent from the host device 200 connected to the image forming apparatus 1, the control portion 100 causes a print job to be started. First, the control portion 100 performs "receiving of image data" from the host device 200 (S101). The image data is RGB data for the three colors of red (R), green (G) and blue (B) in a two-dimensional array of 8 bits having a resolution of 600 DPI. Next, the control portion 100 performs "image data processing" at the image signal processing circuit 101 (S102). In the image data processing, the RGB image data is subjected to color separation and the resulting data is overwritten onto and stored on the image memories MY, MM, MC and MK as image data DY, DM, DC and DK of the four YMCK colors, i.e., yellow (Y), magenta (M), cyan (C) and black (K). Next, the control portion 100 starts an "image forming operation" (S103). When the image forming operation is started, the image data DY, DM, DC and DK are converted to laser drive signals by the image signal processing circuit 101, and the laser drive signals are sent to the respective exposure devices 4 for the corresponding colors. As a result, image forming is performed as described above.

When the transfer of the image data to the exposure devices 4 is completed, the control portion 100 performs a "determination on performing a cleaning operation on the charging roller 3" (S104). The details of the determination on performing a cleaning operation on the charging roller 3 will be described later. If the control portion 100 determines that a cleaning operation on the charging roller 3 is required, the control portion 100 causes a "charging roller cleaning operation" to be performed (S105). The details of the charging roller cleaning operation will be described later. On the other hand, if the control portion 100 determines that a charging roller cleaning operation is not required, the control portion 100 advances the processing to 5106. Next, the control portion 100 performs an operation to check "is there next image data?" (S106). If the control portion 100 determines that there is unprocessed image data, the control portion 100 returns the processing to S102 and repeats the above described processing. In contrast, if the control portion 100 determines that processing of all the image data is completed and there is no next image data, the control portion 100 ends the print job.

Thus, in the present embodiment, a cleaning operation on the charging roller 3 is performed during a sheet interval process as a time of non-image formation. However, the present disclosure is not limited thereto, and a cleaning operation on the charging roller 3 may be performed, for example, during a post-rotation process, during a pre-rotation process or during a pre-multi-rotation process as long as the relevant process is a time of non-image formation.

4. Adherence of Toner to Charging Roller

The image forming apparatus 1 of the present embodiment adopts an in-line system. Therefore, when a toner image that was formed on the intermediate transfer belt 8 at an upstream image forming portion S passes through a downstream primary transfer nip N1, a phenomenon referred to as a "retransfer" occurs in which some toner of the toner image moves to the photosensitive drum 2 of the downstream image forming portion S. This phenomenon occurs due to the fact that, at the downstream primary transfer nip N1, toner on the intermediate transfer belt 8 receives an electric discharge that arises due to a difference in potential between the charging potential portion of the photosensitive drum 2 and the primary transfer roller 7 and becomes toner that is charged to a polarity that is the reverse of the normal polarity. Toner that adheres to the photosensitive drum 2 due to such a retransfer is referred to as "retransferred toner". A voltage of −1100 V is applied to the charging roller 3 during image forming to attract the retransferred toner that is reversely charged toner. Therefore, the main scanning direction distribution of the amount of toner that adheres to the charging roller 3 correlates with the main scanning direction distribution of the print pixel area of the toner image that passed through the primary transfer nip N1.

In the image forming apparatus 1 of the present embodiment, the amount of retransferred toner when a 100% yellow image was formed was approximately 1.0% when measured at the image forming portion SK for black. The method for measuring the retransferred toner amount is as follows. The retransferred toner adhering to the photosensitive drum 2 after a toner image passes through the primary transfer nip N1 is collected using a polyester tape, and the polyester tape is attached onto fine quality paper. Further, as a reference, polyester tape in its original state is attached onto fine quality paper that is arranged side by side with the aforementioned polyester tape. The optical density of each of the polyester tapes on these fine quality papers is measured through a complementary color filter for the toner color using a whiteness meter TC-6DS manufactured by Tokyo Denshoku Co. Ltd. A difference between the two measurement results is taken as the amount of retransferred toner.

A 100% yellow image having a belt shape extending in the sub-scanning direction was consecutively printed on A4-sized recording materials S, and image density changes due to retransferred toner adhering to the charging roller 3 were organoleptically evaluated. Evaluation of the image density changes was performed using the image forming portion SK for black. As a result, in the case of a uniform image in the main scanning direction that is formed by the aforementioned belt-shaped images being uniformly arranged in the main scanning direction, fluctuations in density could be recognized from the 100th page. In contrast, in the case of an image having a distribution in the main scanning direction that is formed by the aforementioned belt-shaped images being arranged with an uneven distribution in the main scanning direction, fluctuations in density could be recognized from the 30th page.

Further, although the developing device 5 coats toner charged to a negative polarity that is the normal charge polarity on the developing roller 52, some of the toner becomes reversely charged toner. The reversely charged toner is called "fogging toner". The fogging toner adheres to a portion with a charging potential of the photosensitive drum 2. The fogging toner that is reversely charged toner does not undergo primary transfer, and adheres to the charging roller 3 similarly to the retransferred toner. Because the fogging toner adheres uniformly to the entire surface of the photosensitive drum 2 at a time of non-image formation, the fogging toner adheres uniformly to the entire surface of the charging roller 3. In the image forming apparatus 1 of the present embodiment, the amount of fogging toner measured at the respective image forming portions SY, SM, SC and SK was approximately 0.5%. The method for measuring the amount of fogging toner is the same as the method for measuring the amount of retransferred toner except that the position at which toner is collected with the polyester tape is between the developing roller 52 and the primary transfer nip N1 in the rotational direction of the photosensitive drum 2.

An all-white image was consecutively printed on A4-sized recording materials P, and image density changes due to adherence of fogging toner on the charging roller 3 were organoleptically evaluated. Evaluation of the image density changes was performed using the image forming portion SK for black. As a result, density fluctuations could be recognized from the 200th page.

5. Charging Roller Cleaning Operation

When toner adheres to the charging roller 3, because the capability of the charging roller 3 to charge the photosensitive drum 2 changes, in some cases the photosensitive drum 2 cannot be uniformly charged and image density fluctuations arise. Therefore, as a maintenance operation, at a time of non-image formation the image forming apparatus 1 of the present embodiment performs a cleaning operation on the charging roller 3 in which toner that adheres to the charging roller 3 is expelled to the photosensitive drum 2 to thereby reduce the amount of toner adhered to the charging roller 3.

In the present embodiment, in the charging roller cleaning operation, first, the photosensitive drum 2 and the developing roller 52 are separated to thereby suppress the adherence of new toner to the photosensitive drum 2. Next, a direct current voltage of −1100 V that is the same as at a time of image formation is applied to the charging roller 3, and the surface of the photosensitive drum 2 is charged to −500 V. Further, in synchrony with a timing at which the region charged to −500 V of the photosensitive drum 2 arrives at the primary transfer nip N1, the voltage applied to the primary transfer roller 7 is switched to 0 V. At the primary transfer nip N1, because a difference in potential between the surface of the photosensitive drum 2 that was charged to −500 V and the primary transfer roller 7 does not exceed an electric discharge threshold, an electric discharge does not occur on the surface of the photosensitive drum 2, and the surface potential of the photosensitive drum 2 immediately prior to passing next through a charging nip Ch is maintained at −500 V. In synchrony with a timing at which the region charged to −500 V of the photosensitive drum 2 arrives at the charging nip Ch, the voltage applied to the charging roller 3 is switched to 0 V. By this means, an electric field is formed in the opposite direction to the direction of an electric field at a time of image formation between the charging roller 3 and the photosensitive drum 2. That is, at a time of image formation, the charging voltage applied to the charging roller 3 is higher on the normal charge polarity side of the toner than the surface potential of the photosensitive drum 2, and between the charging roller 3 and the photosensitive drum 2 an electric field is formed that directs the reversely charged toner from the photosensitive drum 2 toward the charging roller 3. On the other hand, at a time of the charging roller cleaning operation, the surface potential of the photosensitive drum 2 is higher on the normal charge polarity side of the toner than the potential of the charging roller 3, and between the charging roller 3 and the photosensitive drum 2 an electric field is formed that directs the reversely charged toner from the charging roller 3 toward the photosensitive drum 2. As a result, reversely charged toner adhering to the charging roller 3 is expelled onto the photosensitive drum 2.

Thereafter, in synchrony with a timing at which the reversely charged toner that was expelled onto the photosensitive drum 2 arrives at the primary transfer nip N1, the voltage applied to the primary transfer roller 7 is switched to −1000 V, which is a direct current voltage of reverse polarity to that at a time of image formation. The polarity of this direct current voltage is the reverse of the polarity of the reversely charged toner. By this means, the reversely charged toner that was expelled onto the photosensitive drum 2 receives a force that directs the reversely charged toner from the photosensitive drum 2 to the intermediate transfer belt 8 at the primary transfer nip N1, and is thereby transferred onto the intermediate transfer belt 8. The reversely charged toner on the intermediate transfer belt 8 is conveyed by the intermediate transfer belt 8. In synchrony with a timing at which the reversely charged toner arrives at the secondary transfer nip N2, a direct current voltage of +300 V, which is a direct current voltage of the same polarity as that at a time of image formation is applied to the secondary transfer outer roller 12. The polarity of this direct current voltage is the same as the polarity of the reversely charged toner. Therefore, the reversely charged toner passes through the secondary transfer nip N2 in a state in which the reversely charged toner remains on the intermediate transfer belt 8. Subsequently, the reversely charged toner is removed from the intermediate transfer belt 8 and recovered by the belt cleaning apparatus 14. The performing time period of the charging roller cleaning operation of the present embodiment is a time period in which the charging roller 3 makes three complete rotations, so that toner adhering to the charging roller 3 is adequately expelled. The performing time period of the charging roller cleaning operation can be within a range from a time period in which the charging roller 3 makes one complete rotation to a time period in which the charging roller 3 makes ten complete rotations. Within this range, the performing time period can furthermore be within a range from a time period in which the charging roller 3 makes two complete rotations to a time period in which the charging roller 3 makes four complete rotations.

By performing the charging roller cleaning operation as described above, the charging roller 3 enters a state in which the amount of reversely charged toner adhering thereto is adequately reduced or in which reversely charged toner does not adhere thereto, and the charging capability of the charging roller 3 with respect to the photosensitive drum 2 is restored.

6. Determination on Performing Charging Roller Cleaning Operation

In the present embodiment, a determination on performing a cleaning operation on the charging roller is made based on the results of two calculation methods. One of the calculation methods is based on image data (this method is referred to herein as "calculation method A"), and the other calculation method is based on the integrated number of printed sheets (this method is referred to herein as "calculation method B"). Control for determining whether to perform the charging roller cleaning operation is performed by the control portion 100 during the operational sequence for a print job.

(Calculation Method A)

Figure 5:
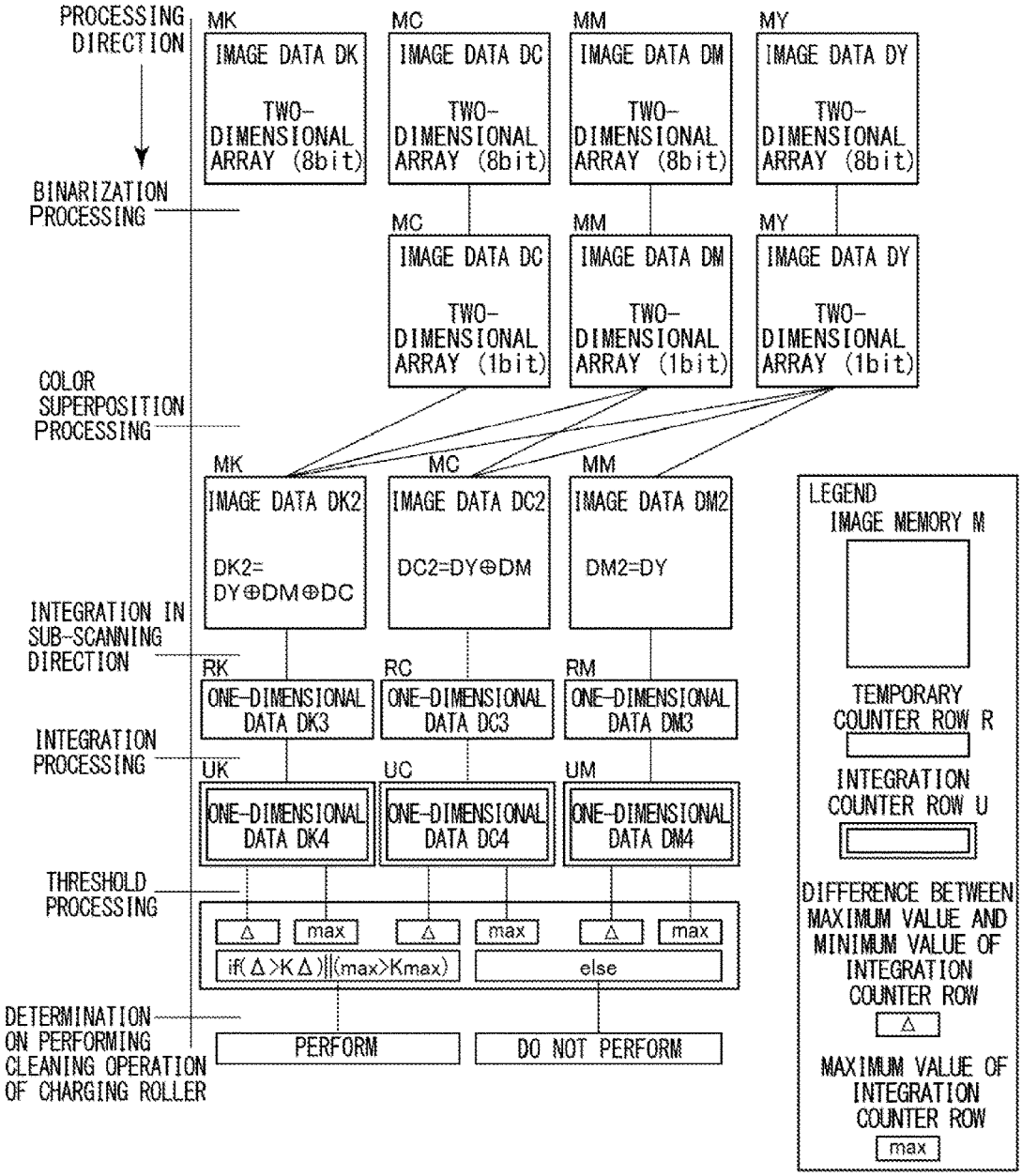
FIG. 5 is a schematic diagram illustrating a data processing process for a determination on performing a charging roller cleaning operation of Embodiment 1.

First, calculation method A will be described. According to calculation method A, whether or not a charging roller cleaning operation is required is determined based on the amount of reversely charged toner attributable to a retransfer that is adhering to the charging roller 3. FIG. 5 is a schematic diagram for describing a data processing process in calculation method A for determining whether to perform a charging roller cleaning operation. In calculation method A, the main scanning direction distribution of the amount of reversely charged toner adhering to the charging roller 3 is estimated based on image data as information relating to a toner image.

First, image data DY, DM and DC for the three colors of YMC that is stored on the image memories MY, MM and MC is binarized. The reason for performing such binarization is that, among the information relating to the amount of toner, a retransfer that is the cause of the occurrence of reversely charged toner that adheres to the charging roller 3 has a higher correlation with the print area than with the absolute amount of toner. Further, since a retransfer is a phenomenon in which toner of a toner image formed at an upstream image forming portion S adheres to the photosensitive drum 2 of a downstream image forming portion S, the image of the most downstream image forming portion SK does not contribute to a retransfer. Therefore, processing of the image data DK for black is not performed.

Next, color superposition processing is performed. A result DK2 of a summing operation with respect to the image data DY of yellow, the image data DM of magenta and the image data DC of cyan is stored in the image memory MK. A result DC2 of a summing operation with respect to the image data DY of yellow and the image data DM of magenta is stored in the image memory MC. Further, the image data DY of yellow is stored in the image memory MM (the image data DY is renamed "image data DM2"). The data in the image memory MY is reset, and is not used thereafter. Note that, in the present embodiment a summing operation is performed for each element for the respective items of image data. At this time point, the image data DM2, DC2 and DK2 stored in the image memories MM, MC and MK correspond to data obtained by binarization of image data for toner images that passed through the respective primary transfer nips N1M, N1C and N1K.

Next, integration in the sub-scanning direction is performed. Temporary counter rows RM, RC and RK for three colors that are counter rows having the same length as the number of pixels in the scanning direction of the corresponding image memories are provided in the control portion 100. The image data DM2, DC2 and DK2 are integrated in the sub-scanning direction, and the resulting integrated values are overwritten and stored in the temporary counter rows RM, RC and RK corresponding to each color as one-dimensional data DM3, DC3 and DK3 of the main scanning direction. The one-dimensional data DM3, DC3 and DK3 corresponds to the distribution in the main scanning direction of print pixel areas of the respective toner images that passed through the primary transfer nips N1M, N1C and N1K. The one-dimensional data DM3, DC3 and DK3 correlate with the amount of retransferred toner that moves to the photosensitive drum 2 at the respective primary transfer nips N1M, N1C and N1K.

Next, integration processing is performed. Integration counter rows UM, UC and UK for three colors that are counter rows having the same length as the number of pixels in the scanning direction of the corresponding image memories are provided in the control portion 100. The one-dimensional data DM3, DC3 and DK3 are integrated with current values of the integration counter rows UM, UC and UK corresponding to the respective colors, and the resulting values are overwritten into and stored in the integration counter rows UM, UC and UK corresponding to the respective colors as one-dimensional data DM4, DC4 and DK4. The one-dimensional data DM4, DC4 and DK4 correlate with the integrated amount of toner adhering to the corresponding charging rollers 3M, 3C and 3K.

Finally, threshold checking processing is performed. In the threshold checking processing, a check is performed as to whether or not two values which are the value of a difference between the maximum value and the minimum value among the one-dimensional data DM4, DC4 and DK4 that are count values of the integration counter rows UM, UC and UK, and the value of the maximum value alone exceed predetermined thresholds which are set in advance that correspond to the two values, respectively. If it is determined that at least one of the aforementioned two values exceeds the corresponding threshold, the charging roller cleaning operation is performed as described above (S105 in FIG. 4), and the integration counter rows UM, UC and UK are reset to an initial value (0 in the present embodiment). In contrast, if it is determined that neither of the aforementioned two values exceeds the corresponding threshold, the processing is advanced to the next step (S106 in FIG. 4).

Performing the threshold checking processing with respect to the difference between the maximum value and minimum value of the integration counter rows relates to the reversely charged toner adhering to the charging roller 3, and corresponds to ignoring the amounts that adhere uniformly in the main scanning direction and focusing on the relative difference between the adhering amounts in the main scanning direction. Further, performing the threshold checking processing with respect to the maximum value in the integration counter rows relates to the reversely charged toner adhering to the charging roller 3, and corresponds to focusing on the absolute amount including the amount adhering uniformly in the main scanning direction.

In the present embodiment, as the threshold for the integration counter rows, a value is set that corresponds to a limit at which image density fluctuations caused by adherence of reversely charged toner that is attributable to retransferred toner to the charging roller 3 are visually recognized. Note that, in the present embodiment, the threshold for the integration counter rows is set in page numbers taking a length in the sub-scanning direction of the A4-sized recording material P as a unit. In the present embodiment, the threshold for the aforementioned difference between the maximum value and minimum value is set as 30 pages, and the threshold for the maximum value alone is set as 100 pages.

(Calculation Method B)

According to calculation method B, whether or not a charging roller cleaning operation is required is determined based on the amount of reversely charged toner attributable to fogging that adheres to the charging roller 3. Fogging toner adheres almost uniformly in the main scanning direction to the charging roller 3 of the same image forming portion S as the image forming portion S at which the relevant fogging occurred. The amount of the fogging toner that adheres to the charging roller 3 correlates with the integrated number of printed sheets. In calculation method B, the amount of reversely charged toner that adheres to the charging roller 3 is estimated based on the integrated number of printed sheets.

An integration print counter W that holds a count value for integrated number of printed sheets is provided in the control portion 100. The count value of the integration print counter W is incremented by 1 each time image forming with respect to one side of one recording material P ends. In the threshold checking processing according to calculation method B, a check is performed to determine whether or not the count value of the integration print counter W that is the integrated number of printed sheets exceeds a threshold that is set in advance. If it is determined that the count value exceeds the threshold, the charging roller cleaning operation is performed as described above (S105 in FIG. 4), and the integration print counter W is reset to an initial value (0 in the present embodiment). In contrast, if it is determined that the count value does not exceed the threshold, the processing is advanced to the next step (S106 in FIG. 4).

In the present embodiment, as the threshold for the integration print counter W, a value is set that corresponds to a limit at which image density fluctuations caused by adherence of reversely charged toner that is attributable to fogging toner to the charging roller 3 are visually recognized. In the present embodiment, the threshold for the integration print counter W is set to 200 pages with respect to the A4-sized recording material P.

In the present embodiment, the calculation method A and the calculation method B are independently used. That is, in S104 in FIG. 4, a determination on performing a cleaning operation on the charging roller is performed by both the calculation method A and the calculation method B, and if it is determined by either method that performance of the cleaning operation is necessary, the charging roller cleaning operation in S105 in FIG. 4 is performed. However, the present disclosure is not limited thereto, and for example a calculation method that combines these calculation methods may be used. For example, a method may be mentioned that, in a case where a charging roller cleaning operation was performed based on the calculation method A, resets the integration print counter W that is used for the calculation method B.

Further, the charging roller cleaning operation can be independently performed when required at the image forming portions SM, SC and SK for the colors magenta, cyan and black, respectively. In this case, the integration counter row corresponding to the image forming portion S which performed the charging roller cleaning operation is reset. Alternatively, in a case where it is determined that the charging roller cleaning operation is required at any of the image forming portions SM, SC and SK for the respective colors magenta, cyan and black, charging roller cleaning operations can be performed simultaneously at these image forming portions SM, SC and SK. In this case, the integration counter rows corresponding to the respective image forming portions are simultaneously reset.

7. Advantageous Effects

Next advantageous effects of the present embodiment will be described in contrast with a comparative example. The comparative example differs from the present embodiment in that a determination on performing a cleaning operation on the charging roller is performed only based on the integrated number of printed sheets, which corresponds to the calculation method B in the present embodiment. In the comparative example, the threshold of the integration print counter W was set to 30 pages. Apart from this point, the configuration and operations of an image forming apparatus 1 of the comparative example are substantially the same as the configuration and operations of the image forming apparatus 1 of the present embodiment.

In the comparative example, because information relating to toner images is not taken into consideration, a charging roller cleaning operation is always performed after every 30 pages irrespective of which kind of images are formed.

In contrast, in the present embodiment, because image data is taken into consideration as information relating to toner images, a charging roller cleaning operation is performed at an appropriate timing in accordance with the image data of the images that were formed. Further, in the present embodiment, in a case where, on average, images are formed that have a uniform image pattern in the main scanning direction that are images in which it is difficult to visually recognize image density changes, the number of printed sheets until determining that it is necessary to perform a charging roller cleaning operation substantially increases. Therefore, excessive performance of a charging roller cleaning operation is suppressed, and a decrease in the throughput of the image forming apparatus is suppressed. In the present embodiment, in a case where image patterns that are unevenly distributed with respect to the main scanning direction which are image patterns in which image density changes are easily recognized visually are not consecutively printed, the charging roller cleaning operation is performed, at a maximum, after every 200 pages.

The reason that the advantageous effects described above are obtained in the present embodiment is because of the following features of the present embodiment. One feature of the present embodiment is that the adhering amount of toner to the charging roller 3 of one image forming portion S is estimated based on image data of images formed at image forming portions S that are upstream relative to the relevant one image forming portion S. That is, data that is added to the integration print counter is the image data for image forming portions S that are upstream of the target image forming portion S. In the in-line type image forming apparatus, among toner adhering to the charging roller 3 of one image forming portion S, retransferred toner of toner images that were formed on the intermediate transfer belt 8 at image forming portions S that are upstream of the relevant one image forming portion S is conspicuous. That is, the amount of toner adhering to the charging roller 3 of one image forming portion S can be estimated based on image data of toner images formed at the image forming portions S which are upstream of the relevant one image forming portion S. In the present embodiment, by estimating the amount of toner adhering to the charging roller 3 in this manner, the timing for performing a charging roller cleaning operation can be appropriately determined.

Further, another feature of the present embodiment is that a deviation between integrated values of index values which correlate with an amount of toner borne on each of a plurality of regions in the main scanning direction of the photosensitive drum 2, in particular, a difference between a maximum value and a minimum value, is used to determine the timing at which to perform a charging roller cleaning operation. That is, with regard to the count values of the integration counter rows, not only the maximum value, but also a difference between the maximum value and the minimum value is used to determine the timing at which to perform a charging roller cleaning operation. When the characteristics of the visual perceptions of humans are taken into consideration, image density fluctuations caused by adherence of toner to the charging roller 3 are difficult to perceive when the image density fluctuations are uniform in the main scanning direction. The minimum value of the count values of the integration counter rows corresponds to a toner amount that adheres over the whole area of the charging roller 3. Therefore, by using a difference between the maximum value and minimum value of the count values of the integration counter rows, the contribution of toner that adheres uniformly over the whole area of the charging roller 3 is ignored, and it can be determined whether or not the situation is one in which image density fluctuations that are easily perceived are liable to occur. In the present embodiment, by determining whether or not the situation is one in which image density fluctuations that are easily perceived are liable to occur in this manner, the timing at which to perform a charging roller cleaning operation can be appropriately determined.

As described above, the image forming apparatus 1 of the present embodiment includes movable first and second image bearing members, for example, the photosensitive drums 2Y and 2M for yellow and magenta, respectively, that bear toner images that are transferred to the intermediate transfer belt 8 as a movable transfer-receiving member. The first image bearing member 2Y is disposed further on the upstream side relative to the second image bearing member 2M in the direction of movement of the transfer-receiving member. Further, the image forming apparatus 1 includes first and second charging members, for example, the charging rollers 3Y and 3M for yellow and magenta, respectively, that charge the first and second image bearing members, respectively. The image forming apparatus 1 also includes first and second developing members, for example, the developing devices 5Y and 5M for yellow and magenta, respectively, that supply toner to the first and second image bearing members, respectively, to form a toner image on first and second image bearing members, respectively. Furthermore, the image forming apparatus 1 includes transfer members, for example, the primary transfer rollers 7Y and 7M for yellow and magenta, respectively, that sequentially transfer the toner images from the first and second image bearing members to the transfer-receiving member. The image forming apparatus 1 also has the control portion 100 as a control unit that, at a timing determined based on information relating to the toner image that is formed on the first image bearing member 2Y, causes a cleaning operation that reduces the toner adhered to second charging member 3M to be performed at a time of non-image formation. In the present embodiment, based on information relating to the toner image that is formed on the first image bearing member 2Y, the control portion 100 acquires integrated values of indexes corresponding to an amount of toner borne on each of a plurality of regions in a direction that is approximately orthogonal to the direction of movement of the first image bearing member 2Y. In a case where a difference between a maximum value and a minimum value among the integrated values relating to each of the aforementioned plurality of regions exceeds a predetermined threshold, the control portion 100 causes a cleaning operation to be performed. Further, in the present embodiment, the control portion 100 also causes a cleaning operation to be performed in a case where the maximum value among the integrated values relating to each of the aforementioned plurality of regions exceeds a predetermined other threshold. In particular, in the present embodiment, information relating to a toner image that is formed on the first image bearing member 2Y is the image data corresponding to a toner image that is formed on the first image bearing member 2Y.

By the configuration described above, according to the present embodiment, a decrease in image quality can be suppressed while suppressing a decrease in throughput by performing a maintenance operation at the appropriate timing. In particular, according to the present embodiment, in the in-line type image forming apparatus 1, by performing a charging roller cleaning operation at the appropriate timing, image density fluctuations can be suppressed while suppressing a decrease in the throughput.

Figure 10:
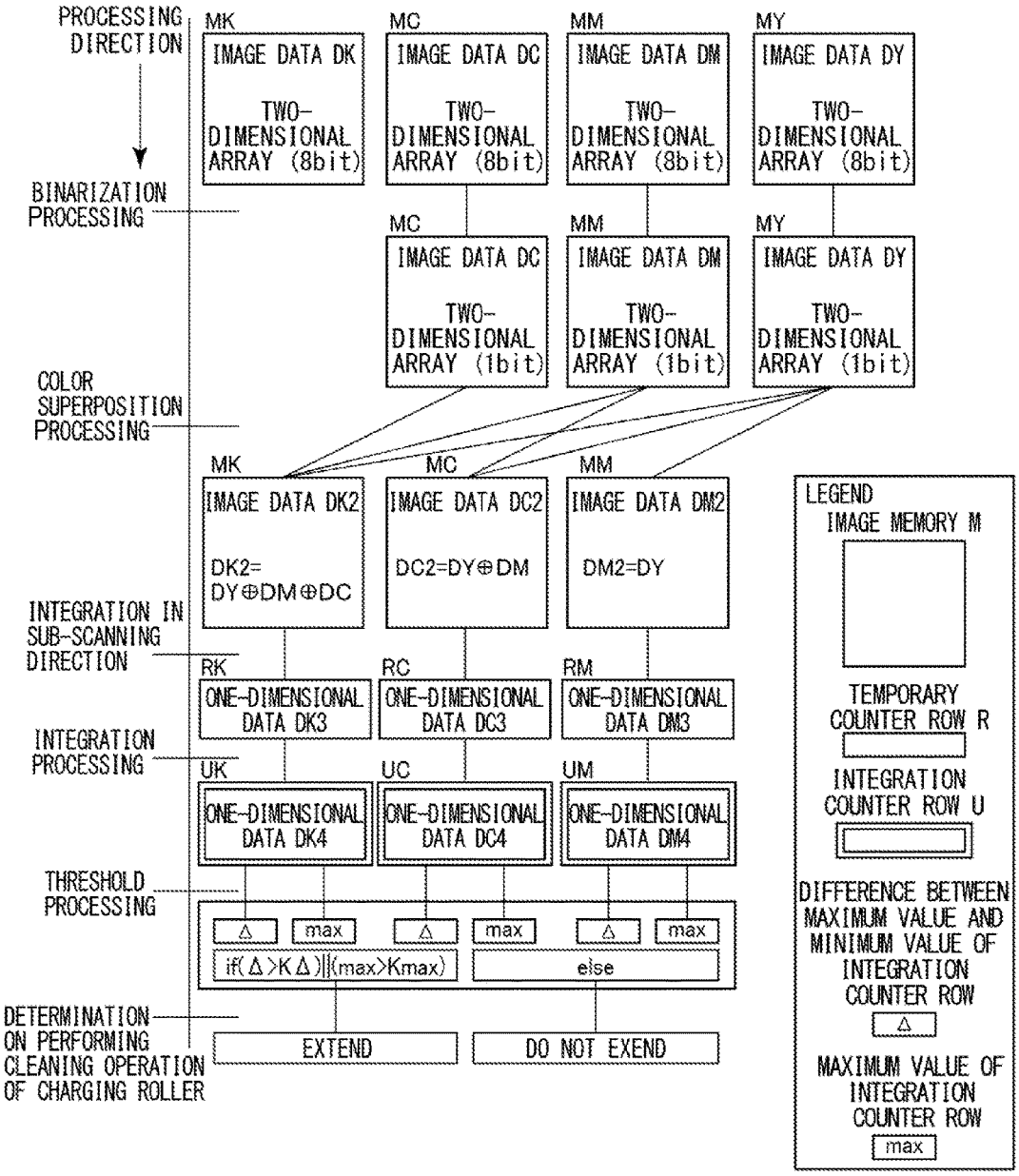
FIG. 10 is a schematic diagram illustrating a data processing process for a determination on extending a charging roller cleaning operation of Embodiment 1.

Further, although according to the configuration of the present embodiment the timing of a charging roller cleaning operation is controlled to suppress image density fluctuations, a similar effect is also obtained by controlling the time period of a charging roller cleaning operation. For example, as illustrated in FIG. 10, in a case where a threshold is exceeded in a situation in which the timing at which to perform a charging roller cleaning operations is fixed, control may be performed so as to extend a cleaning operation with respect to a charging roller in order to suppress image density fluctuations. Specifically, although a charging roller cleaning operation is transitioned to after every 50 pages, and the normal charging roller cleaning operation is performed for a period in which the charging roller 3 makes one complete rotation, in a case where a threshold is exceeded, control is performed so as to perform a charging roller cleaning operation for a period in which the charging roller 3 makes five complete rotations. Accordingly, unlike the comparative example, by adjusting the time period of one cleaning operation for a charging roller in a manner that takes into account information relating to toner, a decrease in throughput can be suppressed to the minimum and image density fluctuations can be favorably suppressed. Further, a threshold may be set at multiple levels, and not just a single level. In addition, both the timing of a charging roller cleaning operation and a time period of the charging roller cleaning operation may be simultaneously controlled.

[Embodiment 2]

Next, another embodiment of the present disclosure will be described. The fundamental configuration and operations of the image forming apparatus of the present embodiment are the same as the image forming apparatus of Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

Figure 6:
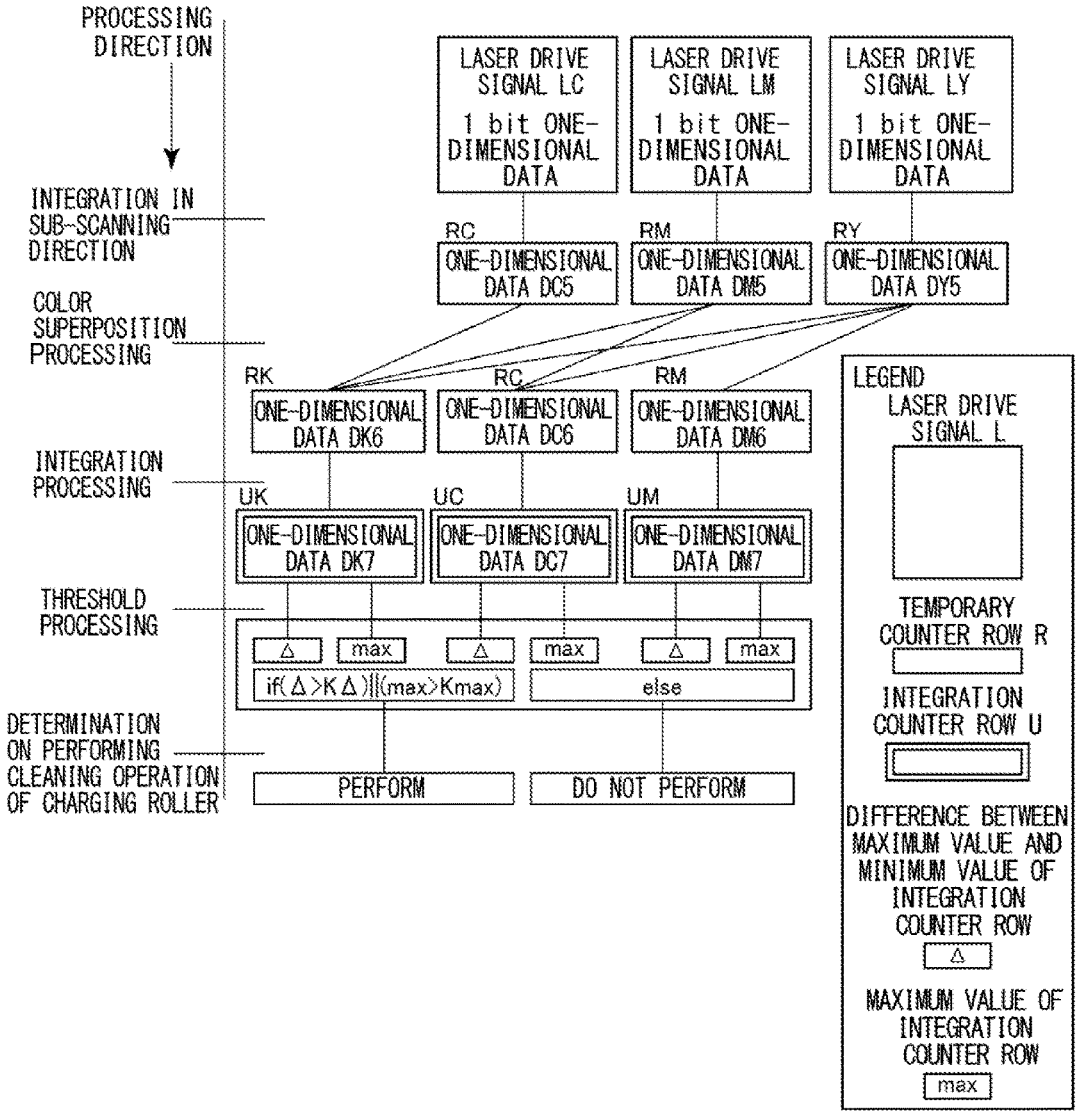
FIG. 6 is a schematic diagram illustrating a data processing process for a determination on performing a charging roller cleaning operation in Embodiment 2.

Unlike Embodiment 1 in which image data is used as information relating to toner images, in the present embodiment laser drive signals are used as information relating to toner images. FIG. 6 is a schematic diagram for describing a data processing process according to the calculation method A with respect to a determination on performing a cleaning operation on the charging roller in the present embodiment.

In the present embodiment, because laser drive signals are used, a determination on performing a cleaning operation on the charging roller is performed concurrently with an image forming operation. Laser drive signals are 1-bit one-dimensional data that control laser lighting, and are transmitted sequentially from the image signal processing circuit 101 to the exposure device 4 during an image forming operation. Integration in the sub-scanning direction of laser drive signals for the respective colors of yellow (Y), magenta (M) and cyan (C) is performed in a main scanning period of the laser for each of the colors, and the resulting data is stored in temporary counter rows RY, RM and RC, respectively. By this means, one-dimensional data DY5, DM5 and DC5 that represents the main scanning direction distribution of laser lighting (light emission time) for each image is obtained.

Next, when the image forming operation ends, color superposition processing is performed. A result DK6 of a summing operation with respect to one-dimensional data DY5 of yellow, one-dimensional data DM5 of magenta and one-dimensional data DC5 of cyan is overwritten onto the temporary counter row RK and stored thereon. Further, a result DC6 of a summing operation with respect to the one-dimensional data DY5 of yellow and the one-dimensional data DM5 of magenta is overwritten onto the temporary counter row RC and stored thereon. Furthermore, the one-dimensional data DY5 of yellow is overwritten onto the temporary counter row RM and stored thereon. In this case, the name of the one-dimensional data DY5 is changed to "one-dimensional data DM6". Except for the fact that the one-dimensional data DM6, DC6 and DK6 are excessively evaluated by an amount corresponding to the color superposition, the one-dimensional data DM6, DC6 and DK6 correlate with the amount of retransferred toner that occurs at the primary transfer nips N1 similarly to the one-dimensional data DM3, DC3 and DK3 of Embodiment 1.

The processing thereafter is the same as the processing from the integration processing onward of Embodiment 1.

Thus, in the present embodiment, information relating to a toner image that is formed on the first image bearing member 2Y is information relating to the light emission time of light that the exposure device 4Y irradiates onto the first image bearing member 2Y based on image data corresponding to a toner image that is to be formed on the first image bearing member 2Y.

Thus, according to the present embodiment the same effects as in Embodiment 1 are obtained and, furthermore, by using laser drive signals and not image data as information relating to toner images the memory and amount of calculation required for image data processing can be reduced.

[Embodiment 3]

Next, another embodiment of the present disclosure will be described. The fundamental configuration and operations of the image forming apparatus of the present embodiment are the same as the image forming apparatus of Embodiment 1. Accordingly, components in the image forming apparatus of the present embodiment that have the same or corresponding functions or configurations as components of the image forming apparatus of Embodiment 1 are denoted by the same reference characters as in Embodiment 1 and a detailed description of such components is omitted hereunder.

In the present embodiment, as a maintenance operation, the image forming apparatus 1 does not perform a charging roller cleaning operation, and instead performs a supply operation to supply toner to a "cleaning nip" CL that is a contact portion between the cleaning member 14*a* of the belt cleaning apparatus 14 and the intermediate transfer belt 8.

1. Supply Operation

Toner that remained on the intermediate transfer belt 8 after secondary transfer is supplied to the cleaning nip CL that is a cleaning portion for the intermediate transfer belt 8 by the cleaning member 14*a*. When toner is supplied to the cleaning nip CL, the toner or external additives (silica particles or the like) of the toner is supplied as a lubricant between the cleaning member 14*a* and the intermediate transfer belt 8. However, in some cases, if there is an uneven distribution in the main scanning direction in the image to be printed, toner is not supplied to some parts in the main scanning direction of the cleaning nip CL. Consequently, a frictional force between the cleaning member 14*a* and the intermediate transfer belt 8 increases, and in some cases burring or chipping of the cleaning blade 14*a* occurs. As a result, a cleaning defect that is a phenomenon whereby secondary un-transferred residual toner is not scraped off by the cleaning member 14*a* and remains on the intermediate transfer belt 8 is liable to occur. Therefore, as a maintenance operation, at a time of non-image formation the image forming apparatus 1 of the present embodiment performs a supply operation that supplies toner to approximately the whole area in the main scanning direction of the cleaning nip CL.

According to the present embodiment, in the supply operation, first a "toner band" that is a band-shaped toner image extending across approximately the whole area of a region in which an image is formable in the main scanning direction is formed at least at one image forming portion among the four image forming portions SY, SM, SC and SK. In the present embodiment, the toner band is formed on the image forming portion SK for black. In a case where the toner band is formed on a plurality of the image forming portions S, the toner bands of each color may be transferred onto the intermediate transfer belt 8 so as to be superposed thereon, or may be transferred so as to be arranged side-by-side in the direction of movement of the intermediate transfer belt 8. In the present embodiment, the toner band is formed by performing the respective processes of charging, exposure and development similarly to a normal image forming operation that is described above. The toner band is transferred onto the intermediate transfer belt 8. Further, in synchrony with a timing at which the toner band that was transferred onto the intermediate transfer belt 8 arrives at the secondary transfer nip N2, a direct current voltage of −300 V that is a direct current voltage of reverse polarity to a voltage applied at a time of image formation is applied to the secondary transfer outer roller 12. By this means, the toner band on the intermediate transfer belt 8 remains on the intermediate transfer belt 8 while passing through the secondary transfer nip N2. Subsequently, the toner band on the intermediate transfer belt 8 is supplied to the cleaning nip CL, and is scraped off by the cleaning member 14*a* and recovered in the recovery container 14*b*.

By the supply operation described above, toner is supplied to approximately the whole area in the main scanning direction of the tip of the cleaning member 14*a*, and thus the occurrence of a cleaning defect is suppressed.

Note that, although in the present embodiment the toner band is formed by performing the respective processes of charging, exposure and development similarly to a time of normal image formation, the toner band may be formed by adjusting a difference in potential between the photosensitive drum 2 and the developing roller 52, and without performing an exposure process and also a charging process. For example, by applying a developing voltage to the developing roller 52 without charging the photosensitive drum 2 and also without performing an exposure operation, toner can be caused to move from the developing roller 52 onto the photosensitive drum 2 to form the toner band.

2. Control Form

Figure 7:
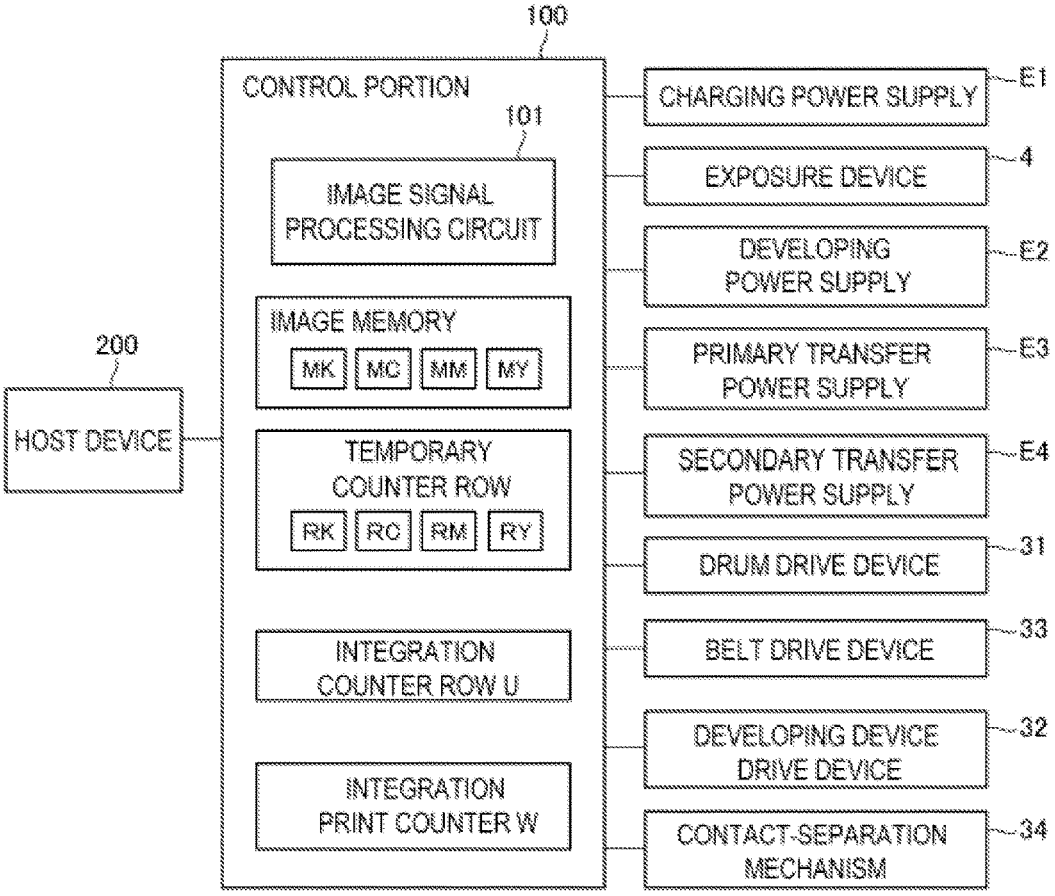
FIG. 7 is a schematic block diagram illustrating a control form of principal parts of an image forming apparatus of Embodiment 3.

FIG. 7 is a schematic block diagram illustrating a control form of principal parts of the image forming apparatus 1 of the present embodiment. Although the control form illustrated in FIG. 7 is roughly the same as the control form illustrated in FIG. 3 in Embodiment 1, in the present embodiment the control portion 100 is provided with temporary counter rows RY, RM, RC and RK for four colors and is also provided with a single integration counter row UK.

3. Operational Sequence of Print Job

Figure 8:
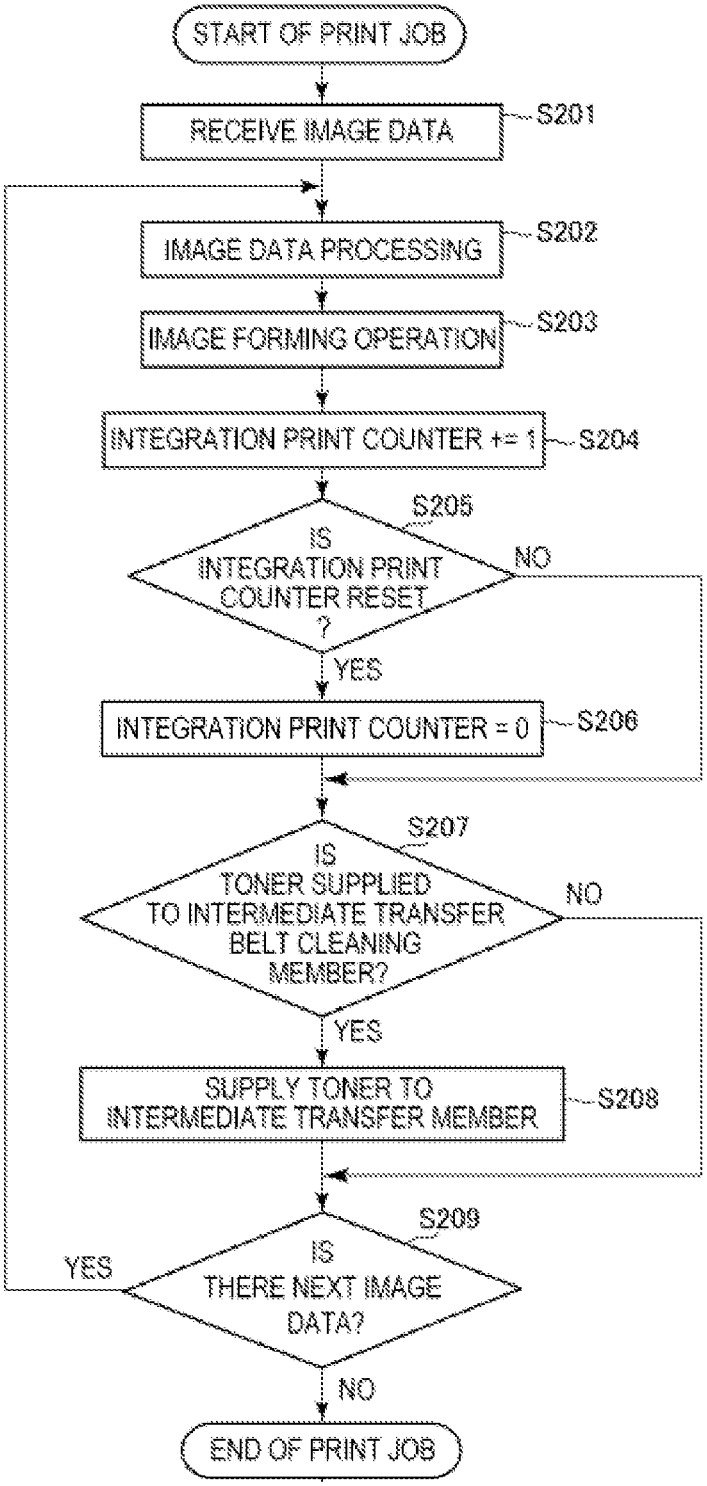
FIG. 8 is a flowchart illustrating an operational sequence of the image forming apparatus of Embodiment 3.

FIG. 8 is a flowchart illustrating an outline of the operational sequence of a print job in the present embodiment.

The processing in S201 to S203 in FIG. 8 is substantially the same as the processing in S101 to S103 in FIG. 4 in Embodiment 1, and in these steps "receiving of image data", "image data processing", and an "image forming operation" are performed, respectively, similarly to Embodiment 1.

In the present embodiment, when an image forming operation ends, the control portion 100 increments by 1 the value of the integration print counter W that counts the number of times an image forming operation has been performed (S204). Next, the control portion 100 performs a "determination on performing a reset of the integration print counter" (S205). The details of the determination on performing a reset of the integration print counter W will be described later. If the control portion 100 determines that resetting of the integration print counter W is to be performed, the control portion 100 resets the value of the integration print counter W to an initial value (0 in the present embodiment) (S206). In contrast, if the control portion 100 determines that resetting of the integration print counter W is not to be performed, the processing is advanced to S207.

Next, the control portion 100 performs a "determination on performing a supply operation" (S207). The details of the determination on performing a supply operation will be described later. If the control portion 100 determines that a supply operation is necessary, the control portion 100 causes a "supply operation" to be performed (S208). In contrast, if the control portion 100 determines that a supply operation is not necessary, the processing is advanced to S209.

The processing in S209 in FIG. 8 is substantially the same as the processing in S106 in FIG. 4 in Embodiment 1. Similarly to Embodiment 1, according to the result of a determination regarding "is there next image data?", the processing is returned to S202 or the print job is ended.

Thus, in the present embodiment, a supply operation is performed during a sheet interval process as a time of non-image formation. However, the present disclosure is not limited thereto, and a supply operation may be performed, for example, during a post-rotation process, during a pre-rotation process or during a pre-multi-rotation process as long as such a process is a time of non-image formation.

4. Determination on Performing Reset of Integration Print Counter

Figure 9:
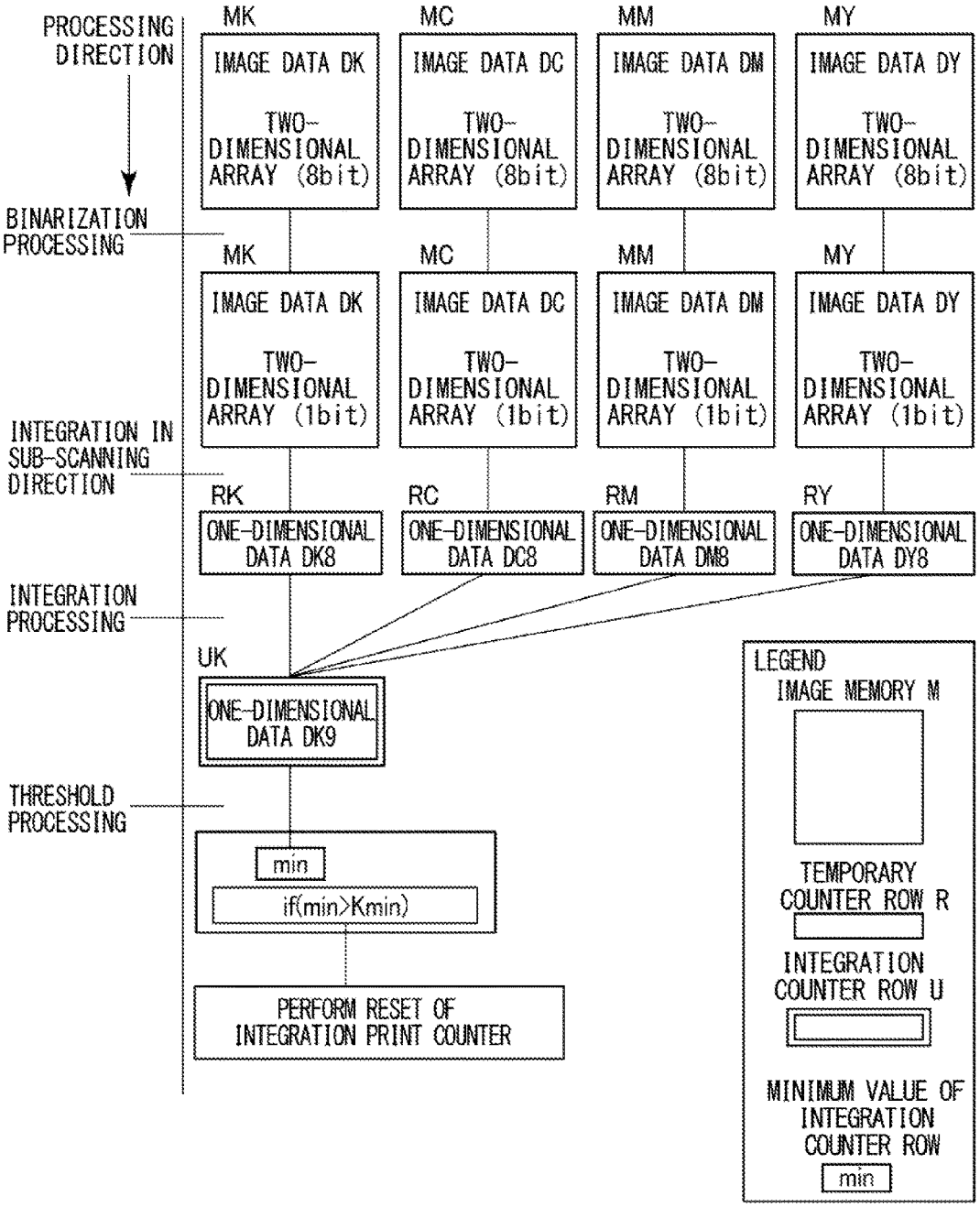
FIG. 9 is a schematic diagram illustrating a data processing process for a determination on performing a supply operation in Embodiment 3.

FIG. 9 is a schematic diagram for describing a data processing process for a determination on performing a reset of the integration print counter W. This control for a determination on performing a reset of the integration print counter W is performed by the control portion 100 in the operational sequence of a print job.

First, image data DY, DM, DC and DK for four colors of YMCK that is stored in the image memories MY, MM, MC and MK is binarized. Next, integration in the sub-scanning direction is performed. That is, the binarized image data is integrated in the sub-scanning direction, and the resulting data is overwritten into and stored in temporary counter rows RY, RM, RC and RK as one-dimensional data DY8, DM8, DC8 and DK8 for the main scanning direction. Next, the one-dimensional data DY8, DM8, DC8 and DK8 are added in sequence to the integration counter row UK. One-dimensional data DK9 of the integration counter row UK corresponds to the main scanning direction distribution of print pixel areas of a toner image that passed through the secondary transfer nip N2. Further, the main scanning direction distribution of print pixel areas of the toner image that passed through the secondary transfer nip N2 correlates with the main scanning direction distribution of the secondary un-transferred residual toner amount.

Finally, threshold checking processing is performed. In the threshold checking processing, a check is performed as to whether or not a minimum value among count values of the one-dimensional data DK9 of the integration counter row UK exceeds a predetermined threshold that is set in advance. If it is determined that the minimum value exceeds the threshold, the integration print counter W is reset to an initial value (0 in the present embodiment) (S206 in FIG. 8). In contrast, if it is determined that the minimum value does not exceed the threshold, the processing is advanced to the next step (S207 in FIG. 8).

In the present embodiment, as the threshold of the integration counter row, a value is set that corresponds to the amount of toner that can adequately suppress the occurrence of a problem caused by an increase in a frictional force between the cleaning member 14*a* and the intermediate transfer belt 8. In the present embodiment, the threshold of the integration print counter W is set to one-fifth of a page taking the length in the sub-scanning direction of the A4-sized recording material P as a unit.

5. Determination on Performing Supply Operation

Next, a determination on performing a supply operation will be described. Control for the determination on performing a supply operation is performed by the control portion 100 in the operational sequence of the print job.

In the present embodiment, in a case where it is determined that the value of the integration print counter W exceeds a predetermined threshold that was set in advance, a supply operation is performed (S208 in FIG. 8). That is, in a case where formation of images having an uneven distribution in the main scanning direction continues, and a state in which toner is not adequately supplied to some part in the main scanning direction of the cleaning nip CL has continued for a predetermined number of prints, a supply operation is performed. When the supply operation is performed, the integration print counter W is reset to an initial value (0 in the present embodiment). On the other hand, if it is determined that the threshold is not exceeded, the processing is advanced to the next step (S209 in FIG. 8).

In the present embodiment, as the threshold of the integration print counter W, a value is set that corresponds to a travelling distance of the intermediate transfer belt 8 at which a state is entered in which there is a possibility that a problem will occur that is caused by an increase in the frictional force between the cleaning member 14*a* and the intermediate transfer belt 8. In the present embodiment, the threshold of the integration print counter W is set to 100 pages of the A4-sized recording material P.

Note that, although in the present embodiment image data is used as information relating to a toner image, laser drive signals may be used as information relating to a toner image, similarly to Embodiment 2.

6. Advantageous Effects

Next, advantageous effects of the present embodiment will be described in contrast with a comparative example. The comparative example differs from the present embodiment in that a determination on performing resetting of the integration print counter W based on image data is not performed. In the comparative example, the threshold of the integration print counter W is set to 100 pages, which is the same as in the present embodiment. Apart from the aforementioned difference, the configuration and operations of an image forming apparatus 1 of the comparative example are substantially the same as the configuration and operations of the image forming apparatus 1 of the present embodiment.

In the comparative example, because information relating to toner images is not taken into consideration, a supply operation is always performed after every 100 pages irrespective of which kind of images are formed. However, in a case where images are formed over the whole area in the main scanning direction, secondary un-transferred residual toner is supplied evenly in the main scanning direction of the cleaning nip CL, and it is difficult for a cleaning defect to occur. Therefore, always performing a supply operation after every 100 pages is excessive, and is the cause of a decrease in the throughput of the image forming apparatus 1.

In contrast, in the present embodiment, in a case where it is determined based on information relating to toner images that an image was formed over the whole area in the main scanning direction, the integration print counter W is reset and performance of a supply operation is postponed. Note that, the present disclosure is not limited to a configuration in which the integration print counter W is reset to an initial value (0 in the present embodiment), and for example a configuration may be adopted so that a predetermined value that is set in advance is subtracted from the integration print counter W. By this means, a decrease in the throughput of the image forming apparatus 1 can be suppressed.

As described above, the image forming apparatus 1 of the present embodiment has the intermediate transfer belt 8 as a movable intermediate transfer member that transports a toner image which underwent a primary transfer onto the intermediate transfer belt 8 from the image bearing member 2 at the primary transfer portion N1 to the secondary transfer portion N2 to be subjected to a secondary transfer onto a recording material. Further, the image forming apparatus 1 has the cleaning member 14*a* that contacts the intermediate transfer member 8 at a position that is downstream from the secondary transfer portion N2 and upstream from the primary transfer portion N1 in the direction of movement of the intermediate transfer member 8, and removes toner from the intermediate transfer member 8. The image forming apparatus 1 also has the control portion 100 as a control unit that causes a supply operation that transfers a predetermined toner image from the image bearing member 2 onto the intermediate transfer member 8 to supply toner to a contact portion CL between the intermediate transfer member 8 and the cleaning member 14*a* to be performed at a time of non-image formation. The control portion 100 obtains integrated values of indexes corresponding to amounts of toner that are borne on each of a plurality of regions in a direction that is approximately orthogonal to the movement direction of the image bearing member 2 based on information relating to a toner image that is formed on the image bearing member 2. In a case where a minimum value among the aforementioned integrated values relating to each of the plurality of regions exceeds a predetermined threshold, the control portion 100 performs control so as to postpone performance of the supply operation. In particular, in the present embodiment, the control portion 100 integrates an image output number each time an image is output, and causes a supply operation to be performed in a case where the integrated value of the image output number exceeds a predetermined value. Together therewith, in a case where the aforementioned minimum value among the integrated values relating to each of the plurality of regions exceeds the aforementioned threshold, the control portion 100 performs control that reduces the aforementioned integrated value of the image output number.

By the configuration described above, according to the present embodiment, a decrease in image quality can be suppressed while suppressing a decrease in throughput by performing a maintenance operation at the appropriate timing. In particular, according to the present embodiment, by performing a supply operation that supplies toner to the cleaning nip CL of the intermediate transfer belt 8 at an appropriate timing, the occurrence of cleaning defects on the intermediate transfer belt 8 can be suppressed while suppressing a decrease in throughput.

[Other]

Although the present disclosure has been described in accordance with specific embodiments, the present disclosure is not limited to the above described embodiments.

Although in the above described embodiments the image forming apparatus is described as an apparatus that adopts an intermediate transfer system, the present disclosure can also be applied to an image forming apparatus that adopts a direct transfer system. As is well-known by those skilled in the art, an in-line type image forming apparatus that adopts the direct transfer system has a recording material carrying member that includes an endless belt or the like instead of the intermediate transfer member in the foregoing embodiments. Further, toner images that are formed on the photosensitive drums of the respective image forming portions are transferred by the primary transfer rollers 7 directly onto a recording material that is borne and transported by a recording material carrying member, in a similar manner to a primary transfer in an image forming apparatus that adopts the intermediate transfer system. In such kind of an image forming apparatus also, by applying the present disclosure in accordance with Embodiments 1 and 2, similar advantageous effects as those obtained in Embodiments 1 and 2 can be obtained.

Further, the photosensitive member is not limited to a photosensitive drum formed in a drum shape, and may be a photosensitive belt formed in an endless belt shape. Furthermore, the intermediate transfer member or recording material carrying member is not limited to a member formed in an endless belt shape, and for example may be a drum-like member formed by providing a film in a tensioned state on a frame body. Further, in the case of an image forming apparatus that adopts an electrostatic recording method, the image bearing member may be an electrostatic recording dielectric body formed in a drum shape or an endless belt shape.

Further, although the supply operation described in Embodiment 3 is favorably used in particular in a case where the cleaning member is a blade-shaped member, the cleaning member is not limited to a blade-shaped member. For example, as long as the cleaning member is a member with respect to which there is a possibility of a problem occurring due to the frictional force increasing, such as a block-like, pad-like, or sheet-like member, the same advantageous effects as the advantageous effects obtained in Embodiment 3 can be expected by applying the present disclosure in accordance with Embodiment 3.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-185300, filed Sep. 26, 2017, which is hereby incorporated by reference herein in its entirety.

What is claimed is:

1. An image forming apparatus configured to form a toner image on a recording material, the image forming apparatus comprising:

a first image forming portion which has a first image bearing member, a first charging member configured to contact the first image bearing member to charge a surface of the first image bearing member, and a first developing member configured to supply toner onto the first image bearing member, and which forms a toner image on the first image bearing member based on image data;

a second image forming portion which has a second image bearing member, a second charging member configured to contact the second image bearing member to charge a surface of the second image bearing member, and a second developing member configured to supply toner onto the second image bearing member, and which forms a toner image on the second image bearing member based on image data;

an intermediate transfer member onto which toner images formed on the first image bearing member of the first image forming portion and the second image bearing member of the second image forming portion are transferred at a first transfer nip portion and a second transfer nip portion and which rotates while bearing the toner images on a surface of the intermediate transfer member, the first transfer nip portion being formed between the first image bearing member of the first image forming portion and the intermediate transfer member contacting the first image bearing member, and the second transfer nip portion being formed between the second image bearing member of the second image forming portion and the intermediate transfer member contacting the second image bearing member;

a transfer member configured to transfer the toner images, which are transferred onto the intermediate transfer member, onto the recording material;

a cleaning member configured to clean toner remaining on a surface of the intermediate transfer member without being transferred to the recording material;

an obtaining portion configured to obtain information relating to a print pixel area from the image data; and a control portion configured to perform a cleaning operation of cleaning the second charging member at a time of non-image formation, wherein the second image forming portion is disposed downstream of the first image forming portion in a rotational direction of the intermediate transfer member, and is disposed upstream of the transfer member with respect to the rotational direction of the intermediate transfer member, wherein the control portion controls a timing of performing the cleaning operation with respect to the second image forming portion based on the information relating to the print pixel area of the toner image that is formed on the first image bearing member of the first image forming portion, and wherein the control portion controls transfer of toner transferred to the second image bearing member by the cleaning operation to the intermediate transfer member, and cleaning by the cleaning member of the toner transferred to the surface of the intermediate transfer member.

2. The image forming apparatus according to claim 1, wherein, based on the information relating to the print pixel area, the control portion obtains, by the obtaining portion, integrated values of indexes corresponding to amounts of toner borne respectively on a plurality of regions on the first image bearing member of the first image forming portion in a rotation axis direction of the first image bearing member, and in a case where a difference between a maximum value and a minimum value among respective integrated values for the plurality of regions exceeds a predetermined threshold, the control portion controls so as to perform the cleaning operation.

3. The image forming apparatus according to claim 2, wherein, in a case where the maximum value among the respective integrated values for the plurality of regions exceeds a predetermined threshold, the control portion controls so as to perform the cleaning operation.

4. The image forming apparatus according to claim 1, wherein the information relating to the print pixel area is a light emission time of light which an exposure device configured to emit light onto the first image bearing member of the first image forming portion emits onto the first image bearing member of the first image forming portion in correspondence with the toner image to be formed on the first image bearing member of the first image forming portion.

5. The image forming apparatus according to claim 1, wherein the first image forming portion and the second image forming portion are configured to, in an image forming operation of forming the toner images on the recording material, recover, by the first developing member and the second developing member, toners that are not transferred to the intermediate transfer member and remain on the first image bearing member and the second image bearing member, respectively.

6. The image forming apparatus according to claim 1, wherein the control portion controls so that, in the cleaning operation, an electric field in an opposite direction to a direction at a time of image formation is formed between the second image bearing member of the second image forming portion and the second charging member of the second image forming portion.

7. The image forming apparatus according to claim 1, wherein the control portion controls a timing of performing the cleaning operation without using the information relating to the print pixel area of the second image forming portion.

8. An image forming apparatus configured to form a toner image on a recording material, the image forming apparatus comprising:

a first image forming portion which has a first image bearing member, a first charging member configured to contact the first image bearing member to charge a surface of the first image bearing member, and a first developing member configured to supply toner onto the first image bearing member, and which forms a toner image on the first image bearing member based on image data;

a second image forming portion which has a second image bearing member, a second charging member configured to contact the second image bearing member to charge a surface of the second image bearing member, and a second developing member configured to supply toner onto the second image bearing member, and which forms a toner image on the second image bearing member based on image data;

an intermediate transfer member onto which toner images formed on the first image bearing member of the first image forming portion and the second image bearing member of the second image forming portion are transferred at a first transfer nip portion and a second transfer nip portion and which rotates while bearing the toner images on a surface of the intermediate transfer member, the first transfer nip portion being formed between the first image bearing member of the first image forming portion and the intermediate transfer member contacting the first image bearing member, and the second transfer nip portion being formed between the second image bearing member of the second image forming portion and the intermediate transfer member contacting the second image bearing member;

a transfer member configured to transfer the toner images, which are transferred onto the intermediate transfer member, onto the recording material;

a cleaning member configured to clean toner remaining on a surface of the intermediate transfer member without being transferred to the recording material;

an obtaining portion configured to obtain information relating to a print pixel area from the image data; and a control portion configured to control a cleaning operation of cleaning the second charging member at a time of non-image formation, wherein the second image forming portion is disposed downstream of the first image forming portion in a rotational direction of the intermediate transfer member, and is disposed upstream of the transfer member with respect to the rotational direction of the intermediate transfer member, wherein the control portion controls a performing time period for performing the cleaning operation with respect to the second image forming portion based on the information relating to the print pixel area of the toner image that is formed on the first image bearing member of the first image forming portion, and wherein the control portion controls transfer of toner transferred to the second image bearing member by the cleaning operation to the intermediate transfer member, and cleaning by the cleaning member of the toner transferred to the surface of the intermediate transfer member.

9. The image forming apparatus according to claim 8, wherein, based on the information relating to the print pixel area, the control portion obtains, by the obtaining portion, integrated values of indexes corresponding to amounts of toner borne respectively on a plurality of regions on the first image bearing member of the first image forming portion in a rotation axis direction of the first image bearing member, and in a case where a difference between a maximum value and a minimum value among respective integrated values for the plurality of regions exceeds a predetermined threshold, the control portion controls so as to extend the performing time period for performing the cleaning operation.

10. The image forming apparatus according to claim 9, wherein, in a case where the maximum value among the respective integrated values for the plurality of regions exceeds a predetermined threshold, the control portion controls so as to extend the performing time period for performing the cleaning operation.

11. The image forming apparatus according to claim 8, wherein the information relating to the print pixel area is a light emission time of light which an exposure device configured to emit light onto the first image bearing member of the first image forming portion emits onto the first image bearing member of the first image forming portion in correspondence with the toner image to be formed on the first image bearing member of the first image forming portion.

12. The image forming apparatus according to claim 8, wherein the first image forming portion and the second image forming portion are configured to, in an image forming operation of forming the toner images on the recording material, recover, by the first developing member and the second developing member, toners that are not transferred to the intermediate transfer member and remain on the first image bearing member and the second image bearing member, respectively.

13. The image forming apparatus according to claim 8, wherein the control portion controls so that, in the cleaning operation, an electric field in an opposite direction to a direction at a time of image formation is formed between the second image bearing member of the second image forming portion and the second charging member of the second image forming portion.

14. The image forming apparatus according to claim 8, wherein the control portion controls the performing time period for performing the cleaning operation without using the information relating to the print pixel area of the second image forming portion.

* * * * *